US008831482B2

(12) United States Patent
Itabashi

(10) Patent No.: US 8,831,482 B2
(45) Date of Patent: Sep. 9, 2014

(54) IMAGE FORMING DEVICE AND DRUM UNIT MOUNTED TO THE SAME

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 309 days.

(21) Appl. No.: 13/356,698

(22) Filed: Jan. 24, 2012

(65) Prior Publication Data

US 2012/0224885 A1 Sep. 6, 2012

(30) Foreign Application Priority Data

Mar. 4, 2011 (JP) ..... 2011-047389

(51) Int. Cl.
*G03G 15/01* (2006.01)
*G03G 15/08* (2006.01)
*G03G 21/18* (2006.01)

(52) U.S. Cl.
CPC ..... *G03G 15/0813* (2013.01); *G03G 21/1821* (2013.01)
USPC ..... 399/228

(58) Field of Classification Search
CPC ..... G03G 15/0813; G03G 21/1821
USPC ..... 399/111, 112, 119, 126, 223, 228
See application file for complete search history.

(56) References Cited

U.S. PATENT DOCUMENTS

| | | | |
|---|---|---|---|
| 6,636,712 | B2 | 10/2003 | Shimaoka |
| 2002/0071693 | A1 | 6/2002 | Shimaoka |
| 2003/0147672 | A1 | 8/2003 | Ahn |
| 2006/0245785 | A1 | 11/2006 | Kawamura et al. |
| 2007/0071481 | A1 | 3/2007 | Kamimura |
| 2007/0147889 | A1 | 6/2007 | Kamimura |

FOREIGN PATENT DOCUMENTS

| | | | |
|---|---|---|---|
| JP | 06186839 | A * | 7/1994 |
| JP | 2002-091125 | A | 3/2002 |
| JP | 2002-091265 | A | 3/2002 |
| JP | 2003-263024 | | 9/2003 |
| JP | 2006-330694 | | 12/2006 |
| JP | 2007-114718 | | 5/2007 |
| JP | 2007-199651 | | 8/2007 |
| JP | 2009-086442 | A | 4/2009 |
| JP | 2009-181002 | A | 8/2009 |
| JP | 2010-282234 | A | 12/2010 |

OTHER PUBLICATIONS

JP Office Action mailed Mar. 12, 2013, JP Appln. 2011-047389, English translation.

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming device includes a photosensitive unit, a developing unit, and a positioning unit. The photosensitive unit is configured to support a photosensitive body. The developing unit includes a developer carrying body and a unit case. The positioning unit configured to adjust a positional relationship between the developer carrying body and the photosensitive body. The positioning unit includes a separating unit configured to separate the developer carrying body from the photosensitive body, and a high pressure unit configured to provide a high pressure contact between the developer carrying body and the photosensitive body. A pressure in the high pressure contact is higher than a pressure in a normal pressure contact. The normal pressure contact is such a pressure that the developer carrying body and the photosensitive body are held during a printing operation.

12 Claims, 16 Drawing Sheets

3(3Y)
151
151a
151a1
151b
151c
151d
151e
31c
3(3M)
3(3C)
152
152a
152a1
152b
152c
152d
152e
3(3K)
34b1
(34)
41b1
(41)
41b1
(41b)
44
4
49
z
x
y

IMAGE FORMING DEVICE AND DRUM UNIT MOUNTED TO THE SAME

CROSS REFERENCE TO RELATED APPLICATION

This application claims priority from Japanese Patent Application No. 2011-047389 filed Mar. 4, 2011. The entire content of this priority application is incorporated herein by reference.

TECHNICAL FIELD

The present invention relates to an image forming device and a drum unit mounted to the same.

BACKGROUND

Conventional image forming device includes a developing unit provided with a developing roller for carrying toner thereon and a frame for supporting a photosensitive drum. The developing roller is in contact with the photosensitive drum during a printing operation, whereas the developing roller is away from the photosensitive when the printing operation is not performed.

SUMMARY

Failure of image formation may occur due to uneven contact between the developing roller and the photosensitive drum in an axial direction of the developing roller. The failure of image formation tends to occur immediately after the developing roller is brought into contact with the photosensitive drum. The uneven contact results from frictional resistance and/or elastic resistance between mechanical components of a developing roller moving mechanism for moving the developing roller toward and away from the photosensitive drum.

In view of the foregoing, it is an object of the invention to provide an image forming device wherein a developing roller and a photosensitive drum are contactable with each other and failure of image formation caused by the uneven contact between the developing roller and the photosensitive drum can be restrained.

In order to attain the above and other objects, the invention provides an image forming device. An image forming device includes a photosensitive unit, a developing unit, and a positioning unit. The photosensitive unit is configured to support a photosensitive body. The developing unit includes a developer carrying body and a unit case supporting the developer carrying body so as to expose a part of the developer carrying body. The developing unit is mounted to the photosensitive unit such that the developer carrying body is in confrontation with the photosensitive body. The positioning unit is configured to adjust a positional relationship between the developer carrying body and the photosensitive body. The positioning unit includes a separating unit configured to separate the developer carrying body from the photosensitive body, and a high pressure unit configured to provide a high pressure contact between the developer carrying body and the photosensitive body. A pressure in the high pressure contact is higher than a pressure in a normal pressure contact. The normal pressure contact is such a pressure that the developer carrying body and the photosensitive body are held during a printing operation.

According to another aspect, the present invention provides a drum unit. A developing unit including a cylindrical developer carrying body is detachably mounted to the drum unit. The drum unit includes a frame, and a positioning unit. The frame is configured to support a photosensitive body. The positioning unit is configured to adjust a positional relationship between the developer carrying body and the photosensitive body. The positioning unit includes a separating unit configured to separate the developer carrying body from the photosensitive body, and a high pressure unit configured to provide a high pressure contact between the developer carrying body and the photosensitive body. A pressure in the high pressure contact is higher than a pressure in a normal pressure contact. The normal pressure contact is such a pressure that the developer carrying body and the photosensitive body are held during a printing operation.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
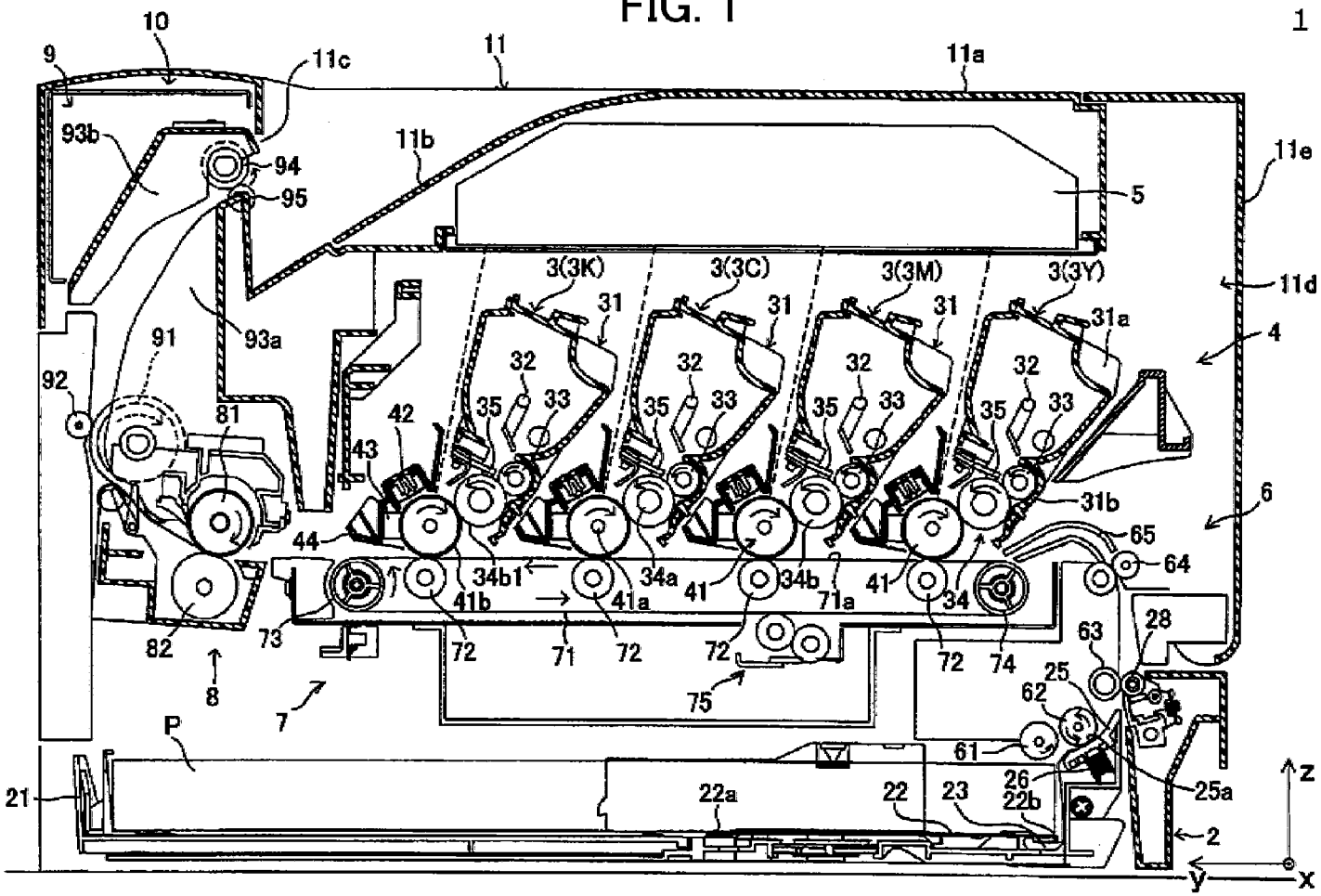
FIG. 1 is a cross-sectional view showing an overall structure of a color laser printer according to a first embodiment of the invention.

A color laser printer 1 according to a first embodiment of the invention will be described while referring to the accompanying drawings wherein like parts and components are designated by the same reference numerals to avoid duplicating description.

The right side of FIG. 1 (negative side of y-axis) defines "front" of the color laser printer 1, and the left side (positive side of y-axis) "rear". The top-to-bottom direction of FIG. 1 (z-axis) defines height direction or top-to-bottom direction of the color laser printer 1, the right-to-left direction of FIG. 1 (y-axis) front-to-rear direction, and a direction orthogonal to the top-to-bottom direction and the right-to-left direction (x-axis) widthwise direction.

The color laser printer 1 is provided with a main frame 10, a sheet cassette 2, a plurality of developing units 3 (a yellow developing unit 3Y, a magenta developing unit 3M, a cyan developing unit 3C, and a black developing unit 3K), a drum unit 4, a scanner unit 5, a sheet feeding mechanism 6, a transferring unit 7, a fixing unit 8, and a discharging unit 9.

The main frame 10 is covered with a main casing 11 having generally box-shape and made from synthetic resin. The main casing 11 has a top surface 11*a* serving as a discharge tray 11*b*, an upper portion formed with a discharge opening 11*c*, and a front portion formed with a front opening 11*d*. The discharge tray 11*b* is for stacking a sheet P discharged from the discharge opening 11*c*. A front cover 11*e* exposing and closing the front opening 11*d* is provided at the front portion and pivotally movable about its bottom end. The front cover 11*e* exposes the front opening 11*d* to the front side to perform an internal maintenance of the color laser printer 1.

[Sheet Cassette]

The sheet cassette 2 is detachably mounted to a bottom portion of the main frame 10 and accommodates stacked sheets P. The sheet cassette 2 includes a cassette case 21, a press plate 22, a lift lever 23, a separation pad 25, a spring 26, and a pinch roller 28. The cassette case 21 forms an outer shell of the sheet cassette 2. The press plate 22 is disposed within the cassette case 21 and has a rear end portion 22*a* and a front end portion 22*b*. The press plate 22 is pivotally movable about the rear end portion 22*a* so as to swing the front end portion 22*b* in the top-to-bottom direction. The lift lever 23 is located below the front end portion 22*b* and adapted to lift the front end portion 22*b* upward.

The separation pad 25 is disposed forward of the cassette case 21 and downstream side of the front end portion 22*b* in a sheet feeding direction. The separation pad 25 has an upper surface serving as a separation surface 25*a* in contact with a front edge of the sheet P conveyed from the cassette case 21 in the sheet feeding direction. The separation surface 25*a* is made of a material having higher friction coefficient than the sheet P, such as rubber. The spring 26 urges the separation pad 25 upward.

The pinch roller 28 is disposed diagonally above and forward of the cassette case 21 and downstream side of the separation pad 25 in the sheet feeding direction. The pinch roller 28 is rotatably supported on the cassette case 21.

[Developing Unit]

The plurality of developing units 3 (the yellow developing unit 3Y, the magenta developing unit 3M, the cyan developing unit 3C, and the black developing unit 3K) is provided within the main frame 10 and above the sheet cassette 2. Specifically, the yellow developing unit 3Y, the magenta developing unit 3M, the cyan developing unit 3C, and the black developing unit 3K are juxtaposed in the order from the front side of the color laser printer 1 to the rear side thereof. The yellow developing unit 3Y, the magenta developing unit 3M, the cyan developing unit 3C, and black developing unit 3K respectively accommodate yellow, magenta, cyan, and black powder toner (dry-type developer). Each developing unit 3 is detachable and attachable relative to each drum unit 4.

Figure 2:
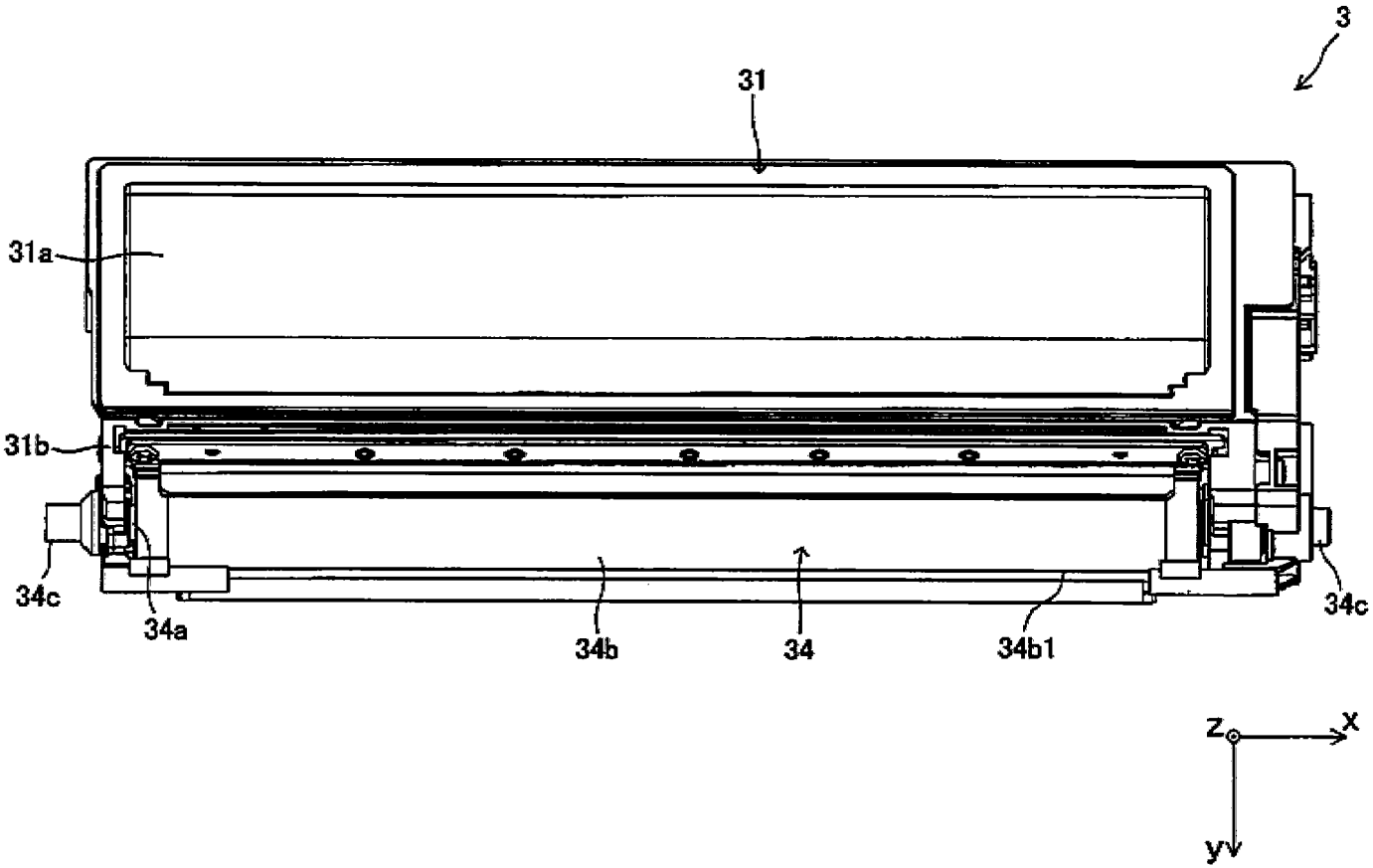
FIG. 2 is a plan view of a developing unit.

As shown in FIGS. 1 and 2, the developing unit 3 includes a unit case 31, an agitator 32, a supply roller 33, a developing roller 34, and a thickness regulating blade 35. The unit case 31 functions as a casing of the developing unit 3 and has a toner accommodating portion 31*a* and a roller supporting portion 31*b*. The toner accommodating portion 31*a* is of a box shape configuring a toner accommodation chamber for accommodating toner and formed with an opening located at a roller supporting portion 31*b* side of an inner peripheral wall thereof. The agitator 32 is adapted to agitate the toner and rotatably provided in the toner accommodating chamber.

As shown in FIG. 1, the roller supporting portion 31*b* rotatably supports the supply roller 33 and the developing roller 34. The supply roller 33 is a sponge roller in contact with the developing roller 34 in order to supply the toner accommodated in the toner accommodating portion 31*a* to the developing roller 34. The developing roller 34 is configured of a metallic shaft 34*a* having a circular rod shape, a roller main body 34*b* made from rubber and coaxially fixed to the shaft 34*a*, and a shaft cover 34*c*. The developing roller 34 is arranged parallel to the supply roller 33.

The supply roller 33 and the developing roller 34 are rotated in the same direction while contacting with each other so as to deposit the charged toner on an outer circumferential surface of the developing roller 34 (hereinafter referred to as "toner carrying surface 34*b*1"). The shaft cover 34*c* is disposed at widthwise ends of the shaft 34*a* and outside of a portion where the roller supporting portion 31*b* rotatably supports the shaft 34*a*. The shaft cover 34*c* has a cylindrical shape and is rotatable relative to the shaft 34*a*.

A part of the toner carrying surface 34*b*1 (opposite to a portion where the supply roller 33 contacts the developing roller 34) is exposed outside of the unit case 31. The thickness regulating blade 35 is provided in the unit case 31 so as to be in sliding contact with the toner carrying surface 34*b*1. The thickness regulating blade 35 is for regulating a thickness of the toner carried on the toner carrying surface 34*b*1 by a radial contact therewith.

[Drum Unit]

The drum unit 4 includes the plurality of photosensitive drums 41, a plurality of chargers 42, a plurality of drum cleaners 43, and a drum frame 44. The drum unit 4 rotatably supports the plurality of photosensitive drums 41 whose number is equal to that of the developing unit 3. The plurality of photosensitive drums 41 extends parallel with each other and is arranged in the front-to-rear direction (y-axis). Each photosensitive drum 41 is in confrontation with each developing roller 34.

The photosensitive drum 41 is configured of a drum shaft 41*a* having a circular rod shape and a drum main body 41*b* having a cylindrical shape and coaxially fixed to the drum shaft 41*a*. The photosensitive drum 41 rotates about the drum shaft 41*a*. The drum main body 41*b* has an outer circumferential surface serving as an image bearing surface 41*b*1 on which an electrostatic latent image corresponding to an image data to be printed is formed and a toner image corresponding to the electrostatic latent image is carried.

The charger 42 is disposed at upstream side of a position where the developing roller 34 confronts the photosensitive drum 41 in a rotational direction of the photosensitive drum 41 (arrows show in FIG. 1 and hereinafter referred to as "drum rotational direction"). The charger 42 is in confrontation with the photosensitive drum 41 with a gap therebetween. The charger 42 is adapted to uniformly charge the image bearing surface 41*b*1.

The drum cleaner 43 is disposed at upstream side of a position where the charger 42 confronts the photosensitive drum 41 in the drum rotational direction. The drum cleaner 43 is in confrontation with the photosensitive drum 41. The drum cleaner 43 is adapted to clean the image bearing surface 41*b*1 along the widthwise direction (axial direction of the photosensitive drum 41, x-axis) before the image bearing surface 41*b*1 is charged by the charger 42.

The drum frame 44 supports the photosensitive drum 41, the charger 42, and the drum cleaner 43. Specifically, the drum frame 44 rotatably supports the plurality of photosensitive drums 41 juxtaposed in the front-to-rear direction (y-axis) perpendicular to the widthwise direction (x-axis). The developing unit 3 is detachably mounted to the drum frame 44. When the developing unit 3 is mounted to the drum frame 44, the toner carrying surface 34*b*1 of the roller main body 34*b* is in confrontation with the image bearing surface 41*b*1 of the drum main body 41*b*.

The drum frame 44 is slidably movable relative to the main frame 10 in the front-to-rear direction (y-axis). That is, the drum frame 44 is drawable from the main frame 10 via the front opening 11*d* while opening the front cover 11*e*. The drum frame 44 may be referred to as slide frame.

Figure 3:
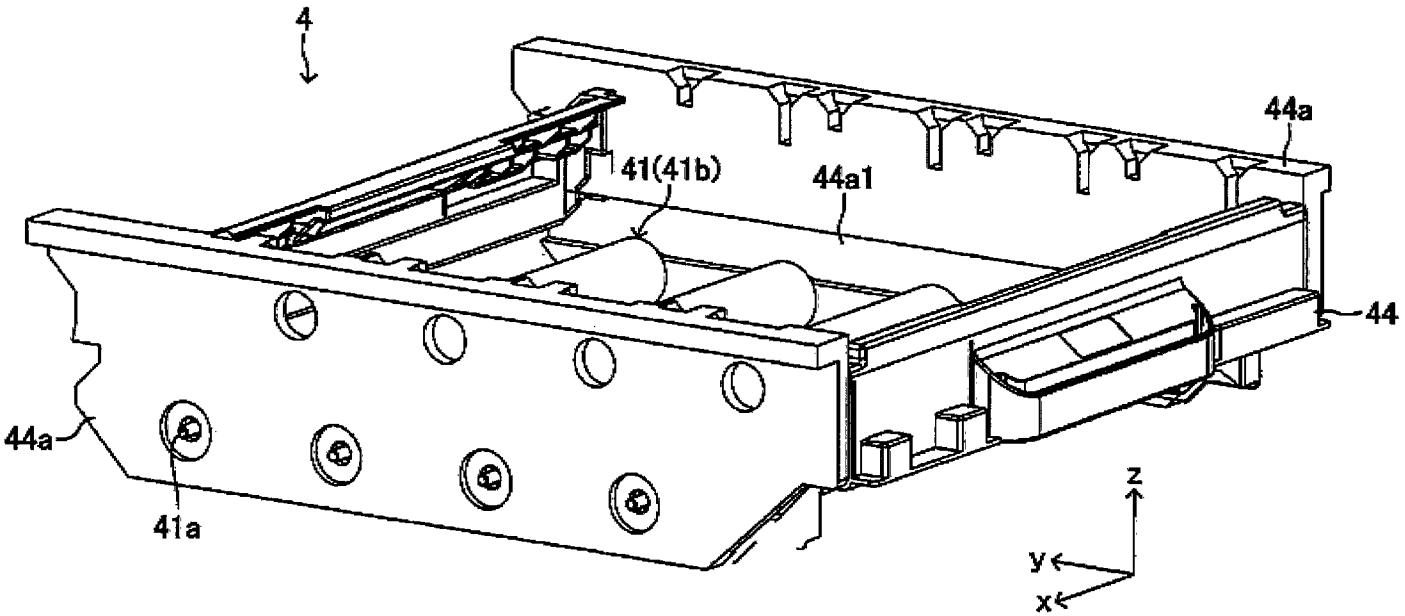
FIG. 3 is a schematic perspective view of a main part of a drum frame.

As shown in FIG. 3, the drum frame 44 includes a pair of side frames 44*a*. The side frame 44*a* is of a plate shape disposed at widthwise (x-axis) ends of the drum frame 44. A longitudinal direction of the side frame 44*a* extends in the front-to-rear direction (y-axis).

Figure 4A:
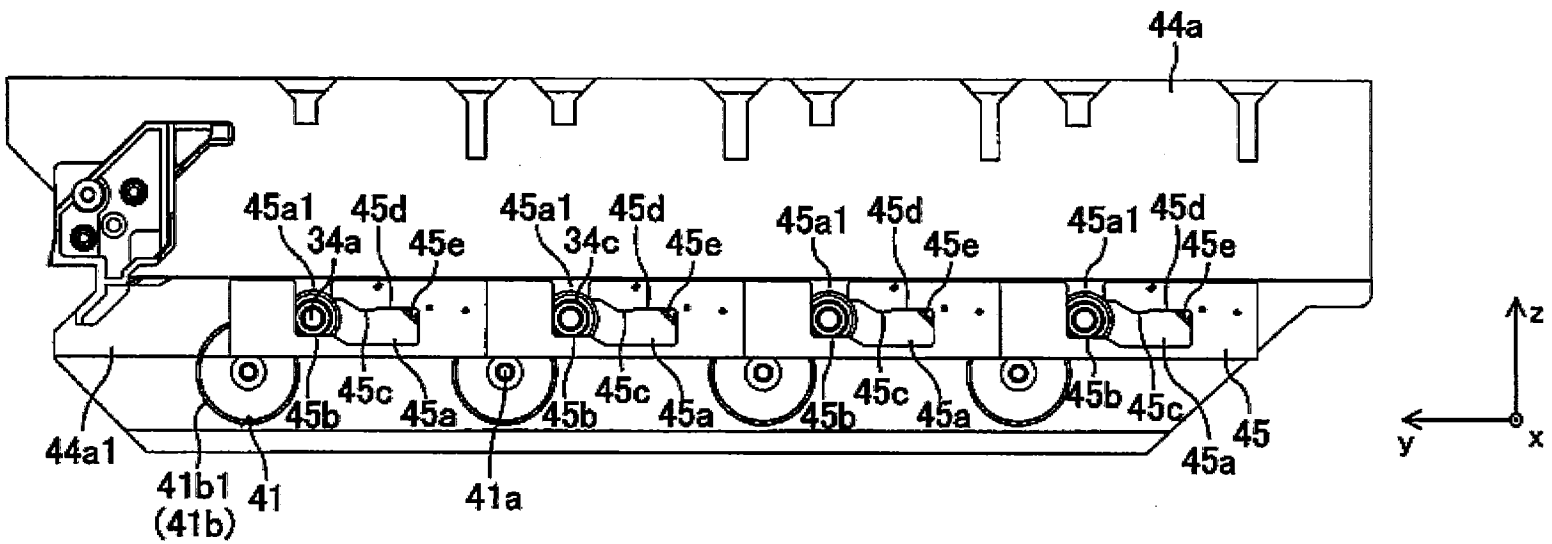
FIG. 4A is a side view of the drum frame shown in FIG. 3 in which one of a pair of side frames (front side in FIG. 3) is removed.
Figure 4B:
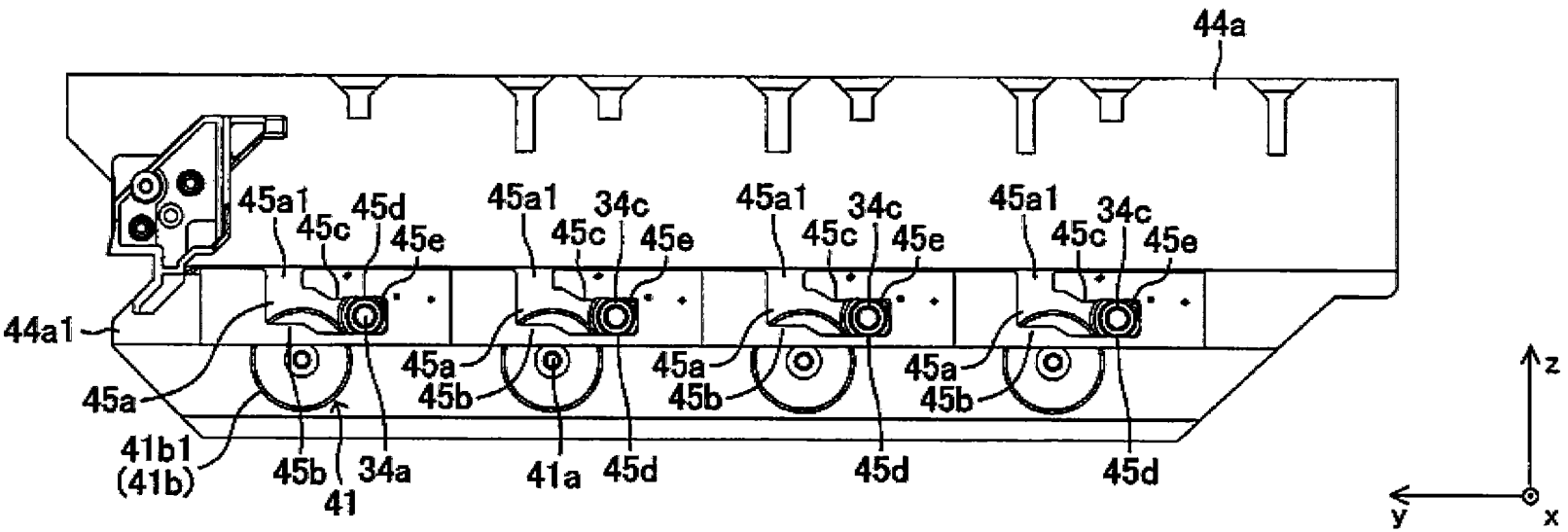
FIG. 4B is a side view of the drum frame shown in FIG. 3 in which one of a pair of side frames (front side in FIG. 3) is removed.

Assuming that, in the FIGS. 4A and 4B, four developing units 3 are mounted in the drum frame 44. For convenience, a depiction of the developing unit 3 other than the shaft 34*a* and the shaft cover 34*c* is omitted in the FIGS. 4A and 4B.

[Positioning Member]

As shown in FIGS. 3, 4A, and 4B, the side frame 44*a* is formed with a slide cam sleeve 44*a*1 along the front-to-rear direction (y-axis). A slide cam 45 is provided in the slide cam sleeve 44*a*1 and slidably movable therein in the front-to-rear direction (y-axis). In the FIGS. 4A and 4B, the slide cam 45 mounted in one side frame 44*a*, which is omitted in FIGS. 4A and 4B, positioned at front side of FIG. 3 is absolutely aligned with the slide cam 45 mounted in the other side frame 44*a*, which is depicted in FIGS. 4A and 4B, positioned at far side of FIG. 3 in the widthwise direction. Thus, only the slide cam 45 mounted in the other side frame 44*a* positioned at far side of FIG. 3 is depicted in FIGS. 4A and 4B.

The slide cam 45 can adjust a positional relationship between the toner carrying surface 34*b*1 and the image bearing surface 41*b*1 while the developing unit 3 is mounted in the drum frame 44 (FIG. 1). Specifically, the slide cam 45 has an elongated rectangular plate shape in side view extending in the front-to-rear direction (y-axis). The slide cam 45 has a height in the height direction (z-axis) slightly smaller than that of the slide cam sleeve 44*a*1 such that the slide cam 45 is smoothly and slidingly movable in the slide cam sleeve 44*a*1 without jerking.

The slide cam 45 is formed with a guide slot 45*a* located at a position corresponding to each shaft 34*a* (shaft cover 34*c*) and extending in the front-to-rear direction (y-axis). The guide slot 45*a* penetrates the slide cam 45 in its thickness direction (x-axis) and defines an opening 45*a*1 opening from a rear end portion of the guide slot 45*a* in the front-to-rear direction (y-axis) to the top (positive side of z-axis).

The shaft cover 34*c* is inserted into the guide slot 45*a* passing through the opening 45*a*1 upon attaching the developing unit 3 (FIG. 2) to the drum frame 44. The guide slot 45*a* has a height in a top-to-bottom direction (z-axis) in a side view loosely fitting with an outer diameter of the shaft cover 34*c* in order to smoothly guide the same without jerking. The guide slot 45*a* provides a positional relationship between the toner carrying surface 34*b*1 and the image bearing surface 41*b*1 based on a relative position of the shaft cover 34*c*.

The guide slot 45*a* defines a separating portion 45*b*, a high pressure portion 45*c*, and a normal pressure portion 45*d* in this order toward the front side (negative side of y-axis).

The separating portion 45*b* is located at the rear end portion of the guide slot 45*a* in the front-to-rear direction (y-axis) and offset above the normal pressure portion 45*d* located at a front end portion of the guide slot 45*a*. The separating portion 45*b* positions the shaft cover 34*c* relatively away from the photosensitive drum 41, separating the toner carrying surface 34*b*1 from the image bearing surface 41*b*1 (separating state). The normal pressure portion 45*d* positions the shaft cover 34*c* relatively adjacent to the photosensitive drum 41, allowing the toner carrying surface 34*b*1 to be in contact with the image bearing surface 41*b*1.

The slide cam 45 is provided with a spring 45*e* located at a position corresponding to the normal pressure portion 45*d*. The spring 45*e* urges the shaft cover 34*c* disposed at the normal pressure portion 45*d* toward the photosensitive drum 41 so as to provide a prescribed pressure between the toner carrying surface 34*b*1 and the image bearing surface 41*b*1 suitable for developing the electrostatic latent image into the toner image (normal contacting state).

The high pressure portion 45*c* is located between the separating portion 45*b* and the normal pressure portion 45*d*. In the first embodiment, the high pressure portion 45*c* protrudes downward from an inner top wall of the slide cam 45. When the shaft cover 34*c* is positioned midway from the separating portion 45*b* to the normal pressure portion 45*d* by the sliding movement of the slide cam 45 in the slide cam sleeve 44*a*1, the high pressure portion 45*c* positions the shaft cover 34*c* such that a pressure between the toner carrying surface 34*b*1 and the image bearing surface 41*b*1 is higher than the prescribed pressure in the normal contacting state (high contacting state).

[Scanner Unit]

Returning FIG. 1, the scanner unit 5 is disposed above the yellow developing unit 3Y, the magenta developing unit 3M, the cyan developing unit 3C, and the black developing unit 3K. The scanner unit 5 includes a laser unit (not shown) irradiating generated and modulated laser beam, as indicated by dotted line in FIG. 1, based on the image data onto the image bearing surface 41*b*1 uniformly charged by the charger 42 to form the electrostatic latent image thereon.

[Sheet Feeding Mechanism]

The sheet feeding mechanism 6 is disposed within the main frame 10 for feeding the sheet P to the developing unit 3 and the drum unit 4. The sheet feeding mechanism 6 includes a pickup roller 61, a separation roller 62, a paper dust removing roller 63, a conveying roller 64, and a sheet guide 65.

The pickup roller 61 is rotatably supported on the main frame 10 and is rotated in a direction indicated by an arrow in FIG. 1 via a drive force transmitting mechanism mounted in the main frame 10. The pickup roller 61 contacts the sheet P, which is lifted upward by the front end portion 22*b* and the lift lever 23, with a predetermined pressure upon starting a printing operation.

The separation roller 62 is rotatably supported on the main frame 10 and is rotated in a direction indicated by an arrow in FIG. 1 via the drive force transmitting mechanism. The separation roller 62 confronts the separation pad 25 and has an outer circumferential surface in contact with the separation pad 25 with a predetermined pressure.

The paper dust removing roller 63 is rotatably supported on the main frame 10. The paper dust removing roller 63 is disposed downstream of the separation pad 25 in the sheet feeding direction and in confrontation with the pinch roller 28. The paper dust removing roller 63 pinches the conveyed sheet P in cooperation with the pinch roller 28 to remove paper dust and foreign materials from the sheet P.

The conveying roller 64 and the sheet guide 65 are disposed between the paper dust removing roller 63 and an yellow image forming section (yellow developing unit 3Y and the drum unit 4). The conveying roller 64 and the sheet guide 65 guide and convey the sheet P having passed through the paper dust removing roller 63 toward a region between the yellow image forming section and the transferring unit 7.

[Transferring Unit]

The transferring unit 7 is disposed within the main frame 10 and below an image forming section (developing unit 3 and drum unit 4). The transferring unit 7 includes a transfer belt 71, a transfer roller 72, a drive roller 73, a driven roller 74, and a belt cleaner 75.

The transfer belt 71 is an endless belt made from a conductive plastic in which conductive particles such as carbon or the like are dispersed in polycarbonate or polyimide. The transfer belt 71 has an upper running section whose outer peripheral surface 71*a* is in confrontation with the plurality of drum units 4. The transfer belt 71 is stretched around the drive roller 73 and the driven roller 74.

The transfer roller 72 is rotatably supported so as to be opposed to each of the plurality of photosensitive drums 41 with respect to the transfer belt 71. The transfer roller 72 is electrically connected to a high voltage power source (not shown) to apply a transfer bias, which is for transferring the toner image formed on the image bearing surface 41*b*1 to the sheet P rested on the transfer belt 71, between the photosensitive drum 41 and transfer roller 72.

The drive roller 73 rotates in a direction as indicated by an arrow in FIG. 1 via the drive force transmitting mechanism mounted in the main frame 10. The drive roller 73 is disposed rearward of the photosensitive drum 41 facing the black developing unit 3K located at a rearmost position of the plurality of developing unit 3. The drive roller 73 drives the transfer belt 71 as indicated by an arrow in FIG. 1.

The driven roller 74 is disposed frontward of the photosensitive drum 41 facing the yellow developing unit 3Y located at a front-most position of the plurality of developing unit 3. The driven roller 74 is rotatably supported on the main frame 10. The driven roller 74 is rotated, as indicated by an arrow in FIG. 1, following the movement of the transfer belt 71 driven by the drive roller 73.

The belt cleaner 75 is disposed below a lower running section of the transfer belt 71. The belt cleaner 75 is adapted to clean the outer peripheral surface 71*a* opposed to the image forming section over the entire width thereof.

[Fixing Unit]

The fixing unit 8 is disposed within the main frame 10 and downstream of the transferring unit 7 in the sheet feeding direction. The fixing unit 8 fixes the toner image transferred on the sheet P thereto. The fixing unit 8 includes a heat roller 81 and a pressure roller 82.

The heat roller 81 includes a thin cylindrical shaped main body made of metal and having an outer surface subjected to a release treatment, and a halogen lamp accommodated in the main body. The heat roller 81 is rotated in a direction as indicated by an arrow in FIG. 1 via the drive force transmitting mechanism mounted in the main frame 10. The pressure roller 82 is a silicon rubber roller for pressing the heat roller 81 with a predetermined pressure. The pressure roller 82 rotates following a rotation of the heat roller 81 with the sheet P nipped therebetween, fixing the toner image onto the sheet P by heat and conveying the sheet P toward the discharge opening 11*c*.

[Discharging Unit]

The discharging unit 9 is located above the fixing unit 8 and a rearmost portion of the main frame 10. The discharging unit 9 discharges the sheet P having passed through the fixing unit 8.

The discharging unit 9 includes a feeding roller 91, a pinch roller 92, a pair of guides 93*a* and 93*b*, a discharge roller 94, and a follower roller 95.

The feeding roller 91 and the pinch roller 92 are disposed downstream of the heat roller 81 and the pressure roller 82 in the sheet feeding direction. The feeding roller 91 is supported in the main frame 10 and rotatable in a direction as indicated by a dotted arrow in FIG. 1.

The follower roller 95 is in confrontation with the discharge roller 94. The follower roller 95 is supported in the main frame 10 and follows the rotation of the discharge roller 94 in a direction as indicated by an arrow in FIG. 1. By the rotation of each of the discharge roller 94 and the follower roller 95 in the direction as indicated by the arrow in FIG. 1, the sheet P on which the image is fixed is discharged from the discharge opening 11*c* to outside of the main frame 10.

The pair of guides 93*a* and 93*b* are disposed downstream of the feeding roller 91 and the pinch roller 92 in the sheet feeding direction. The pair of guides 93*a* and 93*b* guide the sheet P being conveyed by the feeding roller 91 and the pinch roller 92 to a nip portion between the discharge roller 94 and the follower roller 95.

The discharge roller 94 and the follower roller 95 are disposed adjacent to the discharge opening 11*c* so as to be exposed therefrom. The discharge roller 94 is supported in the main frame 10 and rotatable in a direction as indicated by an arrow in FIG. 1. The follower roller 95 confronts the discharge roller 94 and follows the rotation of the same in the direction as indicated by the arrow in FIG. 1. The discharge roller 94 and the follower roller 95 rotate in the direction to discharge the sheet P on which the toner image is fixed from the discharge opening 11*c* to the outside of the main frame 10.

Advantageous Effect

The advantageous effect of the first embodiment will be described with reference to the accompany drawings.

While the printing operation is not performed, the slide cam 45 moves forward (negative side of y-axis) as shown in FIG. 4A. The shaft cover 34*c* is positioned at the separating portion 45*b*, being relatively separated from the photosensitive drum 41. As a result, the toner carrying surface 34*b*1 and the image bearing surface 41*b*1 are separated from each other, i.e., in the separating state. At this time, the shaft cover 34*c* can move outside of the guide slot 45*a* through the opening 45*a*1, allowing the developing unit 3 (FIG. 2) attached to and detached from the drum frame 44.

Upon stating the printing operation, the slide cam 45 moves rearward (positive side of y-axis) from a state shown in FIG. 4A. Then, the shaft cover 34*c* moves from the separating portion 45*b* to the normal pressure portion 45*d* in the guide slot 45*a*. When the shaft cover 34*c* is positioned at the high pressure portion 45*c* halfway between the separating portion 45*b* and the normal pressure portion 45*d*, the shaft cover 34*c* is urged downward by the high pressure portion 45*c*. As a result, the toner carrying surface 34*b*1 is brought into intimate contact with the image bearing surface 41*b*1 to provide higher pressure therebetween than the normal contacting state.

Subsequently, as shown in FIG. 4B, the shaft cover 34*c* reaches the normal pressure portion 45*d*. Then, the spring 45*e* urges the shaft cover 34*c* downward so as to provide the normal contacting state between the toner carrying surface 34*b*1 and the image bearing surface 41*b*1.

In the first embodiment, the toner carrying surface 34*b*1 and the image bearing surface 41*b*1 are firstly in intimate contact with each other with high pressure in the high contacting state, and after that they are in contact with each other with the prescribed pressure in the normal contacting state. The contacting state between the toner carrying surface 34*b*1 and the image bearing surface 41*b*1 can be uniformed in the widthwise direction, thereby effectively preventing the toner image from degrading due to the uneven contact.

While the invention has been described in detail with reference to the embodiment thereof, it would be apparent to those skilled in the art that various changes and modifications may be made therein without departing from the spirit of the invention.

Some of typical modifications will be described. In the following description, like parts and components have been designated with the same reference numerals as those used in the first embodiment to avoid duplicating description.

The present invention is not limited to the laser printer capable of printing color print. Monochrome laser printer, monochrome or color copier, or electro photographic type image forming device can be available. Instead of the transfer belt 71 of the first embodiment, the present invention can employ an intermediate transfer belt or photosensitive belt capable of carrying toner image thereon. In this case, the drum frame 44 may support the transfer roller 72, the drive roller 73, and the driven roller 74 instead of the photosensitive drum 41, and intermediate belt or the photosensitive belt may be stretched around these rollers.

The slide cam 45 of the first embodiment is not limited to this configuration. For example, the separating portion 45*b* may be a spring for urging the shaft cover 34*c* upward. In this state, the guide slot 45*a* is formed in generally rectangular shape in the front-to-rear direction (y-axis). Further, the high pressure portion 45*c* may be a spring having larger pressing force than the spring 45*e*. Further, the spring 45*e* may be avoided.

First Modification of the First Embodiment

A first modification of the first embodiment will be described with reference to FIGS. 5A and 5B wherein like parts and components are designated by the same reference numerals to avoid duplicating description. A guide slot 46 is formed at a position corresponding to the shaft cover 34*c* in the drum frame 44. The guide slot 46 is of U-shape extending a line from the shaft 34*a* the drum shaft 41*a* in a side view when the developing unit 3 (unit case 31) is mounted in the drum frame 44 and the printing operation can be performed. The guide slot 46 guides the shaft cover 34*c* upon the attachment and the detachment of the developing unit 3 relative to the drum frame 44.

The drum frame 44 is provided with a press lever 47 for pressing the unit case 31 downward in order to provide the normal contacting state, and a unit case support member 48 for supporting the toner accommodating portion 31*a* of the unit case 31 from diagonally downward and frontward. The press lever 47 is pivotable about a support shaft 47*a* extending in the widthwise direction (x-axis). The press lever 47 has an upper portion provided with a press part 47*b* urged downward by a spring 45*e* and pressing the unit case 31 downward. The press lever 47 is pivotally supported above the unit case support member 48.

A press levers 120 is located adjacent to each widthwise ends of the shaft 34*a* and pivotable about a support shaft 121 extending in the widthwise direction (x-axis). The press lever 120 is of generally rod shaped and includes a press portion 122 and an operating portion 123. The press portion 122 protrudes from the support shaft 121 toward the shaft cover 34*c* and is capable of pressing the shaft cover 34*c* from above. The operating portion 123 protrudes opposite to the press portion 122 from the support shaft 121 and is urged upward by an actuator (not shown) such as a solenoid mounted in the main frame 10.

As shown in FIG. 4A, the separating portion 45*b* of the slide cam 45 provides the separating state, and the separating state is released when the shaft cover 34*c* is positioned at the normal pressure portion 45*d* as shown in FIG. 4B. In the first modification, the high pressure portion 45*c* and the spring 45*e* of the first embodiment are not provided in the slide cam 45.

Figure 5B:
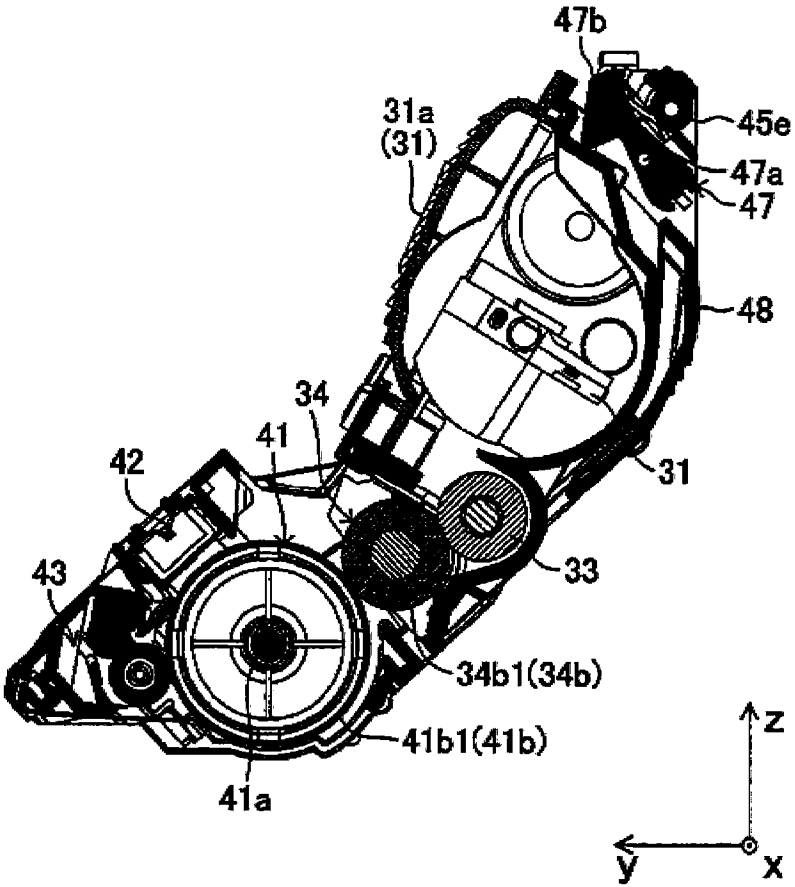
FIG. 5B is a cross-sectional side view of the drum unit and the developing unit according to the first modification.
Figure 5A:
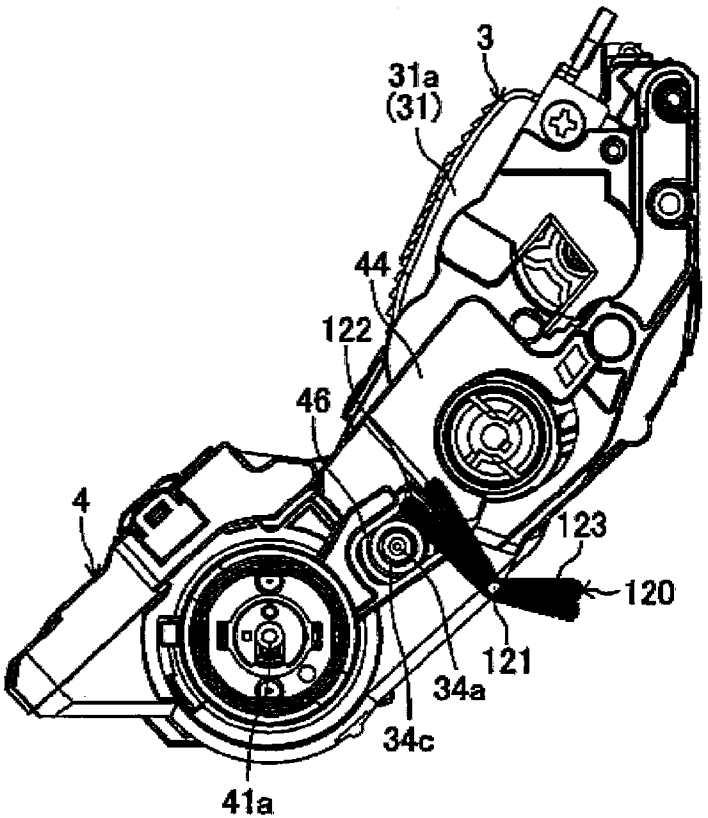
FIG. 5A is a side view of a drum unit and a developing unit according to a first modification of the first embodiment.

The press part 47*b* of the press lever 47 presses, as shown in FIG. 5B, the toner accommodating portion 31*a* of the unit case 31 downward. Consequently, the developing roller 34 is guided by the guide slot 46 and urged to the photosensitive drum 41.

Even if the separating state is released and the press lever 47 urges the unit case 31 downward, the toner carrying surface 34*b*1 may be in uneven contact with the image bearing surface 41*b*1 in the widthwise direction due to the frictional resistance between the shaft cover 34*c* and the guide slot 46.

In the first modification, the press lever 120 rotates to press the developing roller 34 to the photosensitive drum 41 before the printing operation, providing the high contacting state. Sequentially, the press lever 120 reversely rotates, releasing the high contacting. As a result, the contacting state between the toner carrying surface 34*b*1 and the image bearing surface 41*b*1 is at the normal contacting state.

Second Modification of the First Embodiment

Figure 6B:
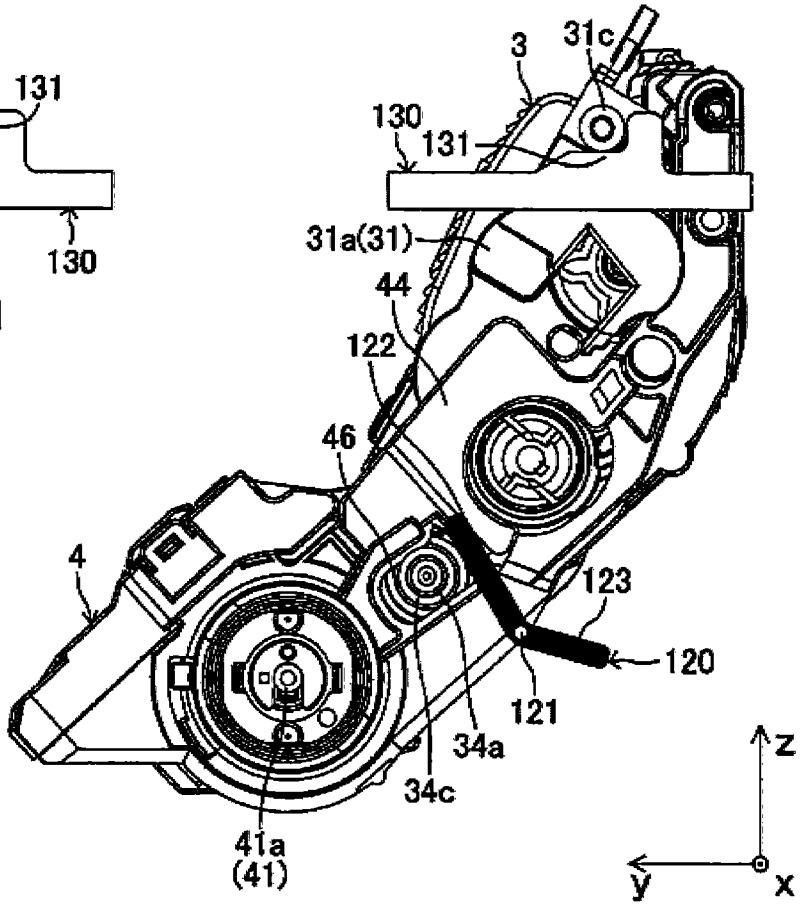
FIG. 6B is a side view of the drum unit and the developing unit when the linear moving cam is in contact with the positioning protrusion according to the second modification.
Figure 6A:
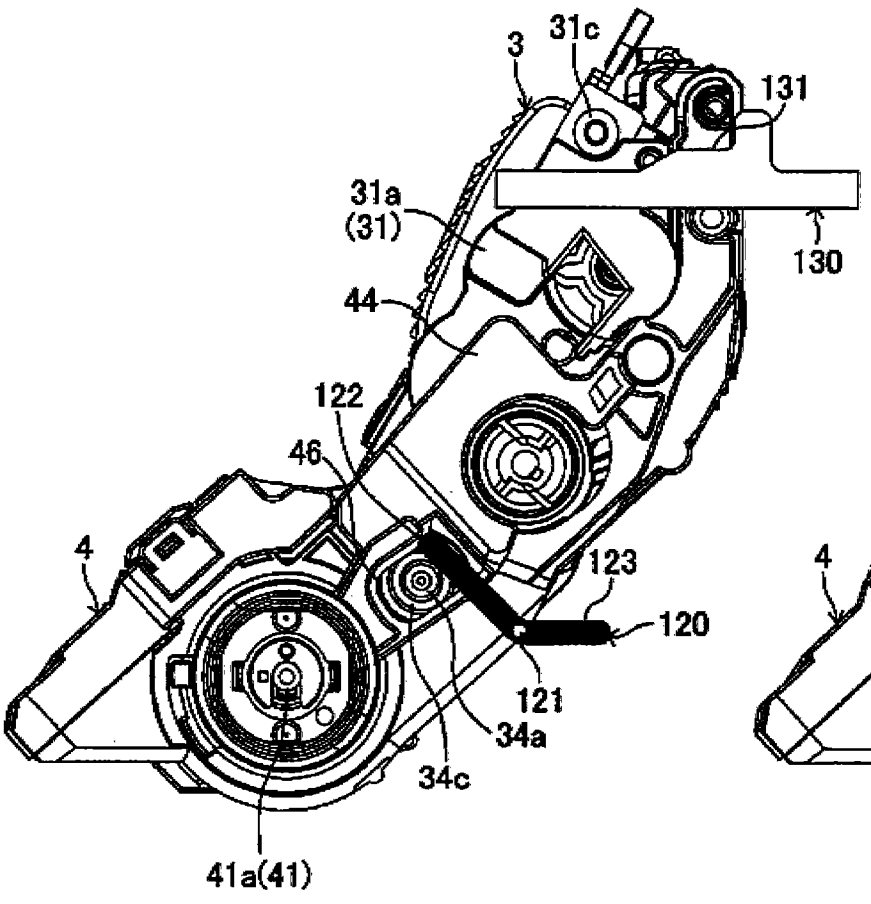
FIG. 6A is a side view of a drum unit and a developing unit when a linear moving cam is away from a positioning protrusion according to a second modification of the first embodiment.

A second modification of the first embodiment will be described with reference to FIGS. 6A and 6B wherein like parts and components are designated by the same reference numerals to avoid duplicating description. The toner accommodating portion 31*a* has an upper portion provided with a pair of positioning protrusions 31*c* protruding outward in the widthwise direction (x-axis). A linear moving cam 130 is provided adjacent to the positioning protrusion 31*c* for moving the same.

In the second modification, the linear moving cam 130 is of a rod shape extending in the front-to-rear direction (y-axis) and disposed below the positioning protrusion 31*c*. The linear moving cam 130 is reciprocally movable in the front-to-rear direction. The linear moving cam 130 is provided with a separating part 131 protruding upward. When the linear moving cam 130 moves rearward (positive side of y-axis) from a state shown in FIG. 6A to a state shown in FIG. 6B, i.e., to a position immediately below the positioning protrusion 31*c*, the separating part 131 lifts the positioning protrusion 31*c* upward, providing the separating state.

In the second modification, the linear moving cam 130 provides and releases the releasing state instead of the slide cam 45 of the first embodiment. The normal contacting state and the high contacting state is provided by the press lever 120 similarly to the first modification shown in FIGS. 5A and 5B.

In the first and second modifications respectively shown in FIGS. 5A, 5B, 6A, and 6B, the press lever 120 and the linear moving cam 130 may be supported on the drum frame 44 shown in FIG. 3 or on the main frame 10 shown in FIG. 1. The same is true with respect to the actuator for actuating the operating portion 123. The press lever 120 may urge the shaft 34*a* downward. The press lever 47 may be omitted, and the normal contacting state may be provided by the weight of the developing unit 3.

The linear moving cam 130 and the positioning protrusion 31*c* may provide not only the separating state but also the normal contacting state and the high contacting state. Specifically, the linear moving cam 130 may include an urging mechanism, for example a leaf spring, located at a position rearward of the separating part 131 on the linear moving cam 130 and urging the positioning protrusion 31*c* downward. In this case, the press lever 120 shown in FIG. 5 is omitted.

Third Modification of the First Embodiment

Figure 7A:
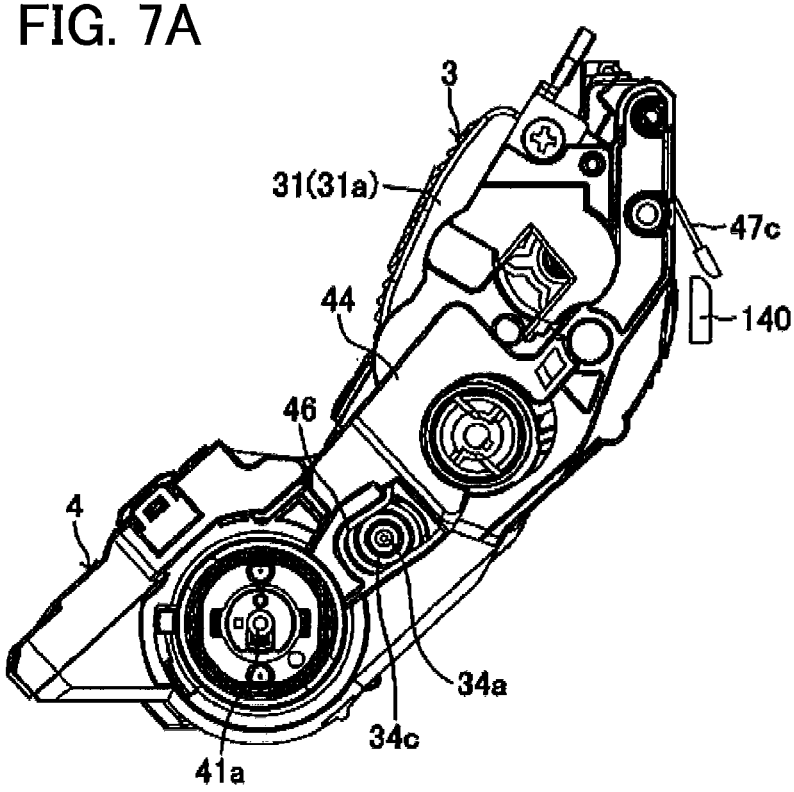
FIG. 7A is a side view of a drum unit and a developing unit when an operating part is away from an actuator according to a third modification of the first embodiment.
Figure 7B:
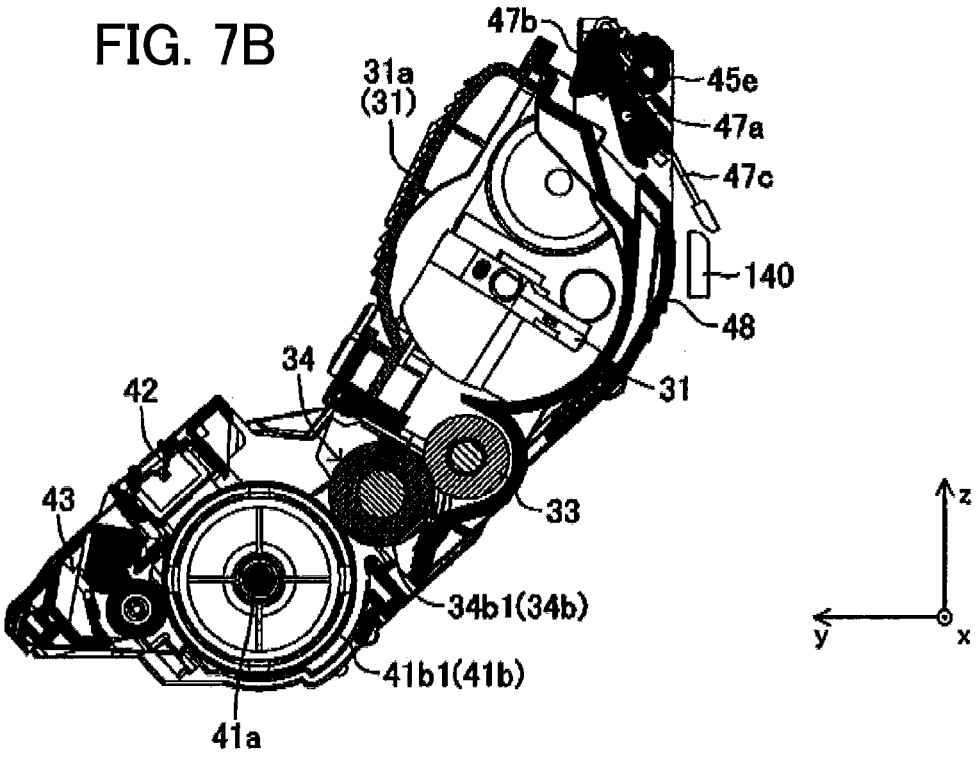
FIG. 7B is a cross-sectional side view of the drum unit and the developing unit when the operating part is away from the actuator according to the third modification.
Figure 8A:
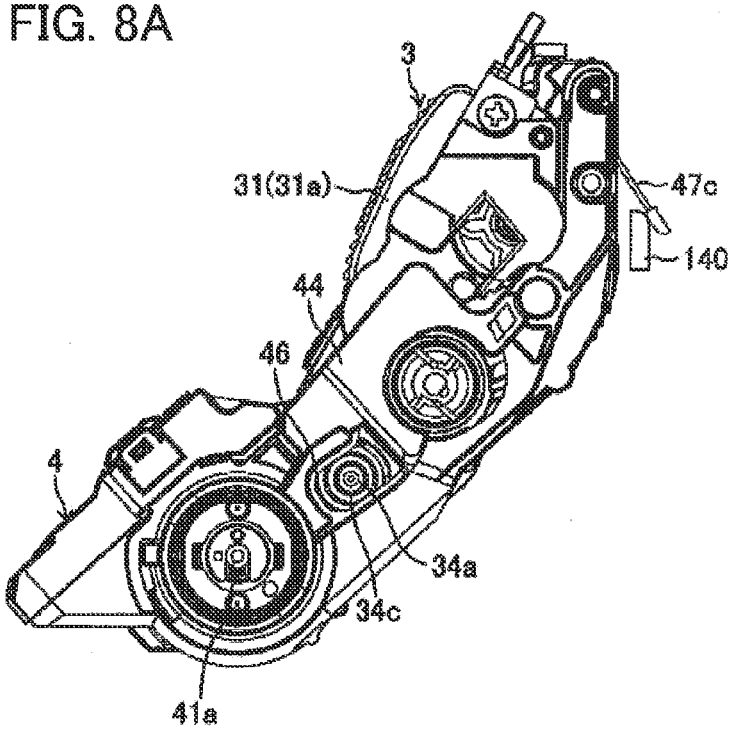
FIG. 8A is a side view of the drum unit and the developing unit when the operating part is in contact with the actuator according to the third modification.
Figure 8B:
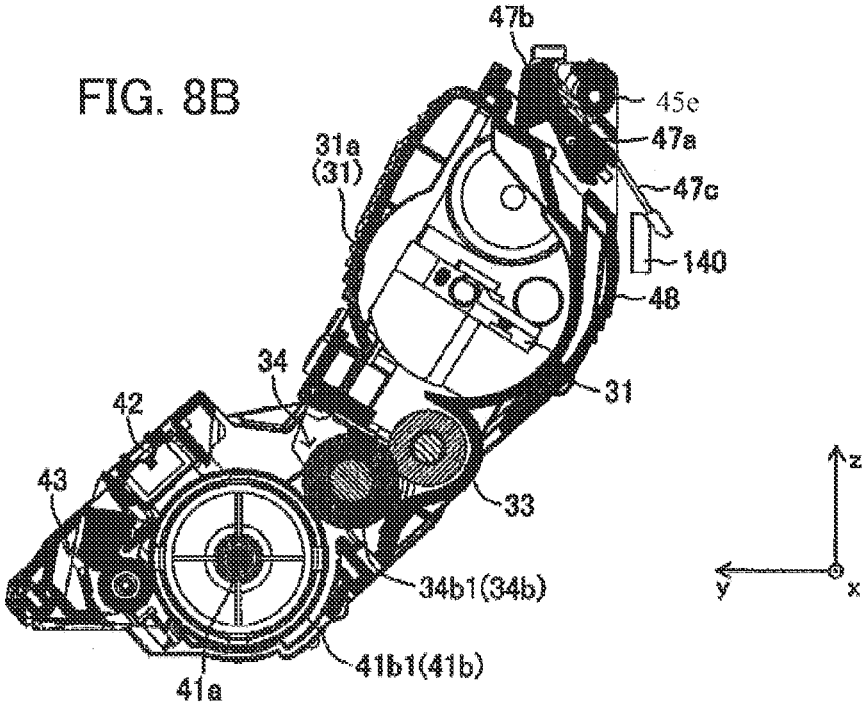
FIG. 8B is a cross-sectional side view of the drum unit and the developing unit when the operating part is in contact with the actuator according to the third modification.

A third modification of the first embodiment will be described with reference to FIGS. 7A, 7B, 8A, and 8B wherein like parts and components are designated by the same reference numerals to avoid duplicating description. The press lever 47 includes an operating part 47*c* located in opposition to the press part 47*b* with respect to the support shaft 47*a*. The operating part 47*c* is pressed upward by an actuator 140, providing the high contacting state as shown in FIGS. 8A and 8B. The actuator 140 does not press the operating part 47*c*, i.e., the press part 47*b* is away from an upper surface of the toner accommodating portion 31*a*, providing the normal contacting state by the weight of the developing unit 3, as shown in FIGS. 7A and 7B.

In the third modification, shown in FIGS. 7A, 7B, 8A, and 8B, the separating state may be provided by the slide cam 45 of the first embodiment or by the linear moving cam 130 of the second modification. The actuator 140 may be supported on the drum frame 44 shown in FIG. 3 or on the main frame 10 shown in FIG. 1.

Second Embodiment

A color laser printer 201 according to a second embodiment of the invention will be described with reference to FIGS. 9 to 15 wherein like parts and components are designated by the same reference numerals to avoid duplicating description.

Figure 9:
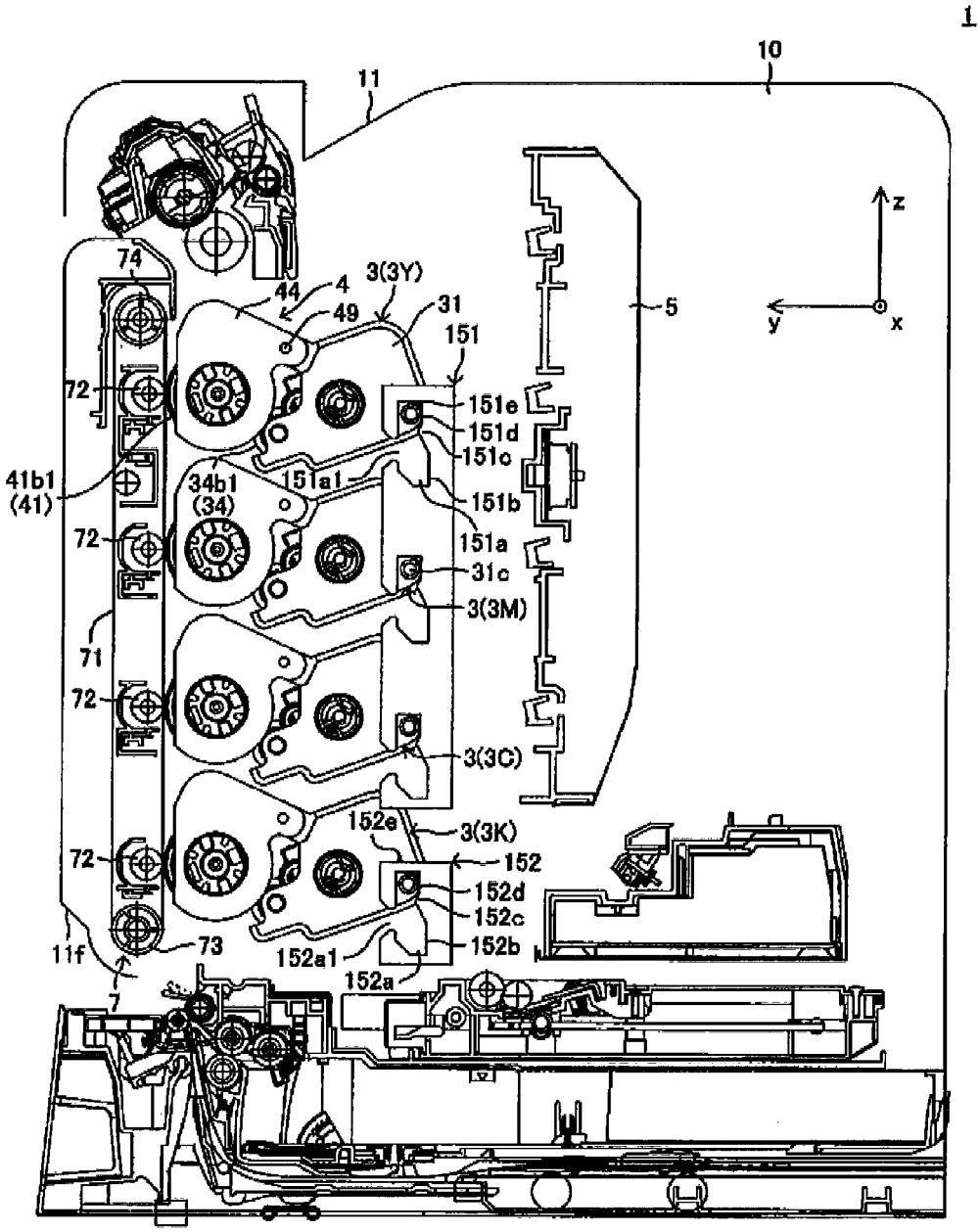
FIG. 9 is a cross-sectional view showing an overall structure of a color laser printer according to a second embodiment of the invention.
Figure 10:
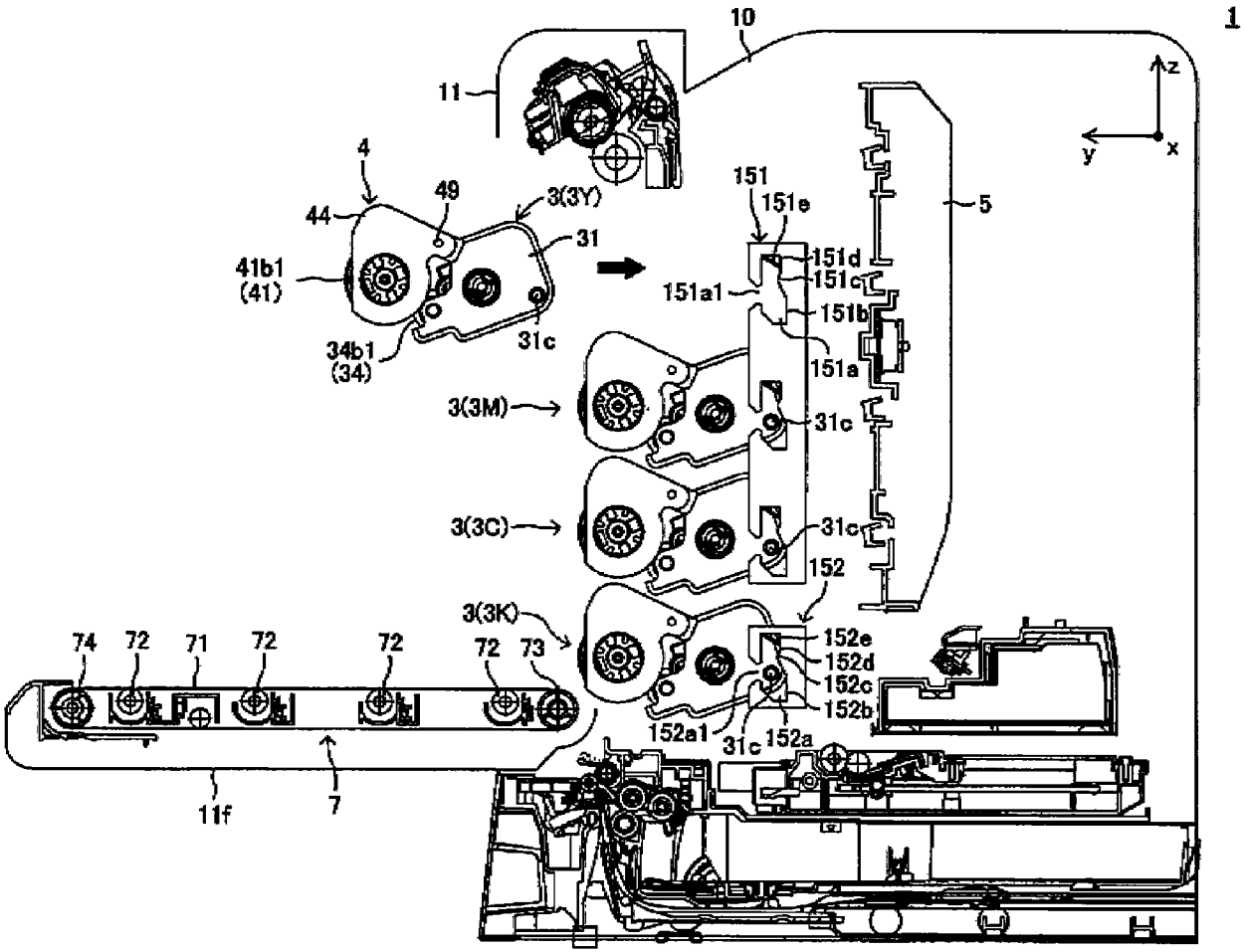
FIG. 10 is a cross-sectional view showing the overall structure of the color laser printer according to the second embodiment when one of drum units is about to be mounted in the color laser printer.

As shown in FIGS. 9 and 10, the yellow developing unit 3Y, the magenta developing unit 3M, the cyan developing unit 3C, and the black developing unit 3K are arranged in this order from top to bottom. The color laser printer 201 is provided with a rear cover 11*f* having the transferring unit 7. The developing unit 3 is detachable from the main frame 10 from rear side (positive side of y-axis) through an opening upon opening the rear cover 11*f*.

The drum unit 4 (the drum frame 44) is divided into the number of the developing unit 3 (the number of photosensitive drum 41). The drum unit 4 and the developing unit 3 are integrally detachable relative to the main frame 10.

Figure 11A:
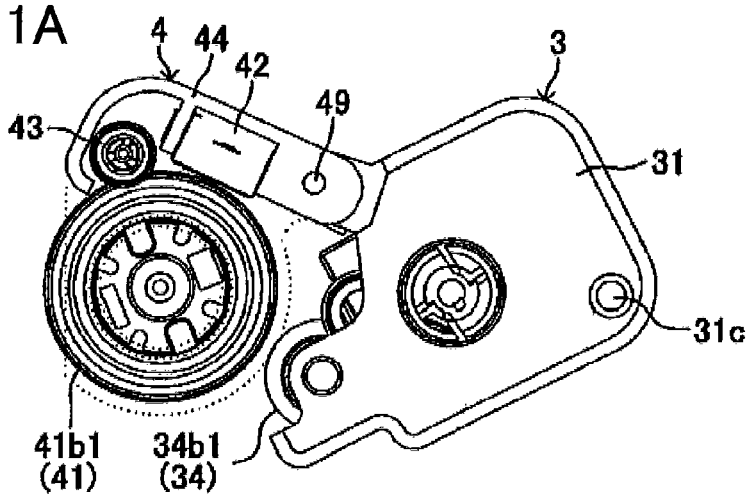
FIG. 11A is a side view of the drum unit and a developing unit in a separating state in which a photosensitive drum is away from a developing roller according to the second embodiment.
Figure 11B:
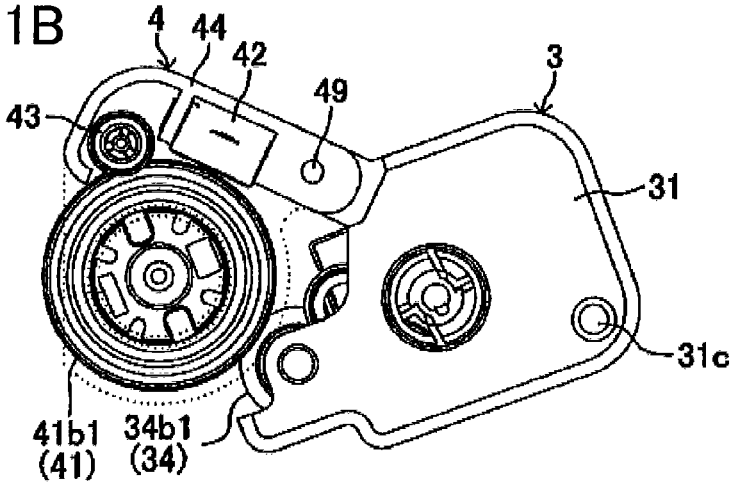
FIG. 11B is a side view of the drum unit and the developing unit in a normal contacting state in which the photosensitive drum contacts the developing roller with a prescribed pressure according to the second embodiment.
Figure 11C:
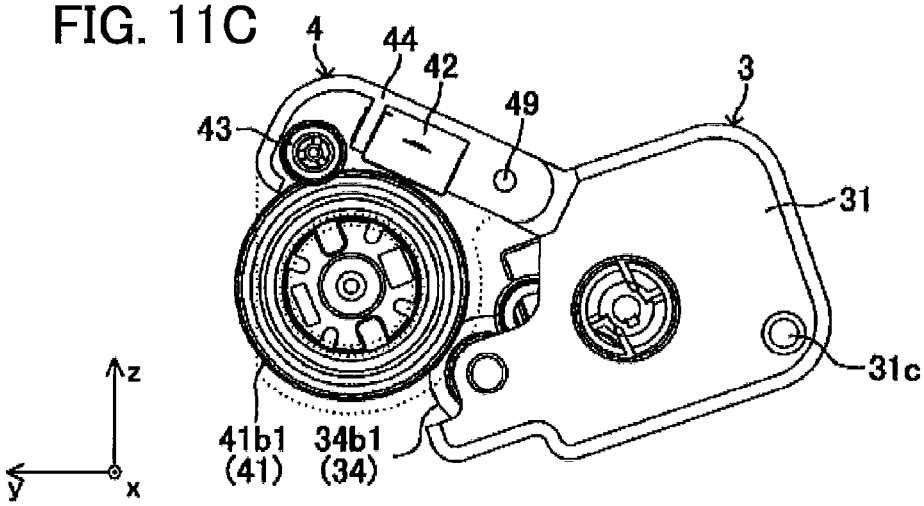
FIG. 11C is a side view of the drum unit and the developing unit in a high contacting state in which the photosensitive drum contacts the developing roller with a high pressure according to the second embodiment.

In the second embodiment, one drum unit 4 is provided with one photosensitive drum 41. That is, one drum frame 44 is provided with the photosensitive drum 41, the charger 42, and the drum cleaner 43 as shown in FIGS. 9 to 11. The unit case 31 and the drum frame 44 are swingably connected with each other about a swing shaft 49 extending in the widthwise direction (x-axis). In the second embodiment, a primary slide cam 151 is provided in the main frame 10 and guides a positioning protrusion 31*c* such that the unit case 31 is relatively pivotable with respect to the drum frame 44, providing the separating state, the normal contacting state, and the high contacting state.

The photosensitive drum 41 is supported to the transfer roller 72 while nipping the transfer belt 71 from rearward upon closing the rear cover 11*f* as shown in FIG. 9. The primary slide cam 151 is movably supported on the main frame 10 in the top-to-bottom direction.

The primary slide cam 151 is formed with a guide slot 151*a* similarly to the first embodiment introducing the positioning protrusion 31*c* via an opening 151*a*1. The guide slot 151*a* defines a separating portion 151*b*, a high pressure portion 151*c*, and a normal pressure portion 151*d*. These portions are arranged in this order from bottom to top (positive side of z-axis).

The normal pressure portion 151*d* is positioned at a bottom portion of the guide slot 151*a* and has a front edge portion offset forward (in a direction away from the photosensitive drum 41) from the normal pressure portion 151*d* located at a top portion of the guide slot 151*a*. The normal pressure portion 151*d* locates the positioning protrusion 31*c* at a position relatively separating from the photosensitive drum 41 to provide the separating state between the toner carrying surface 34*b*1 and the image bearing surface 41*b*1. On the other hand, the normal pressure portion 151*d* locates the positioning protrusion 31*c* at a position relatively adjacent to the photosensitive drum 41 so that the toner carrying surface 34*b*1 is contactable with the image bearing surface 41*b*1.

The primary slide cam 151 is provided with a spring 151*e* located at a position corresponding to the normal pressure portion 151*d*. The spring 151*e* urges the positioning protrusion 31*c* disposed at the normal pressure portion 151*d* toward the photosensitive drum 41 so as to provide a prescribed pressure therebetween suitable for developing the electrostatic latent image into the toner image (the normal contacting state).

The high pressure portion 151*c* is located between the separating portion 151*b* and normal pressure portion 151*d*. The high pressure portion 45*c* protrudes rearward (in a direction toward the photosensitive drum 41) from an inner front wall of the primary slide cam 151. When the positioning protrusion 31*c* is positioned midway from the separating portion 151*b* to the normal pressure portion 151*d* by the sliding movement of the primary slide cam 151, the high pressure portion 151*c* positions the positioning protrusion 31*c* such that a pressure between the toner carrying surface 34*b*1 and the image bearing surface 41*b*1 is higher than the prescribed pressure in the normal contacting state (the high contacting state).

In the second embodiment, the contacting state between the toner carrying surface 34*b*1 and the image bearing surface 41*b*1 in the black developing unit 3K can adjust independently from other three developing units (the yellow developing unit 3Y, the magenta developing unit 3M, and the cyan developing unit 3C). Specifically, the main frame 10 further includes a secondary slide cam 152 for adjusting the contacting state between the toner carrying surface 34*b*1 and the image bearing surface 41*b*1 in the black developing unit 3K in addition to the primary slide cam 151 for adjusting the contacting state therebetween in the yellow developing unit 3Y, the magenta developing unit 3M, and the cyan developing unit 3C.

Similarly to the primary slide cam 151, the secondary slide cam 152 is formed with a guide slot 152*a* introducing the positioning protrusion 31*c* via an opening 152*a*1. The guide slot 152*a* defines a separating portion 152*b*, a high pressure portion 152*c*, and a normal pressure portion 152*d*. These portions are arranged in this order from bottom to top (positive side of z-axis). The secondary slide cam 152 is provided with a spring 152*e* located at a position corresponding to the normal pressure portion 152*d*.

Figure 12B:
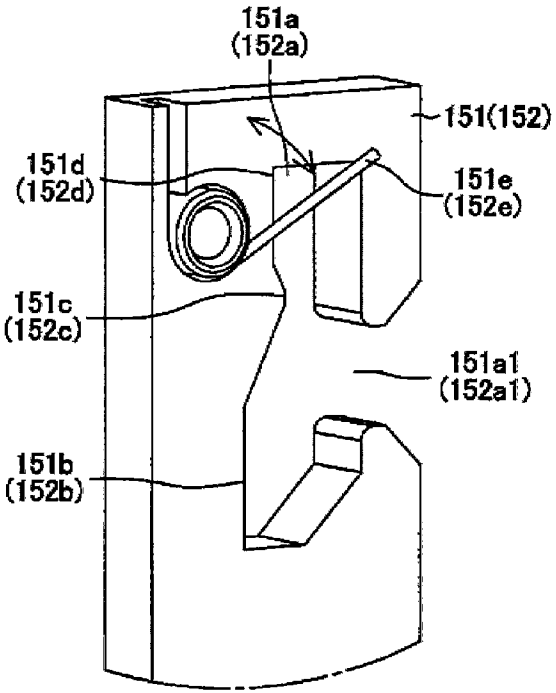
FIG. 12B is an partial enlarged perspective view of the primary slide cam according to the second embodiment.
Figure 12A:
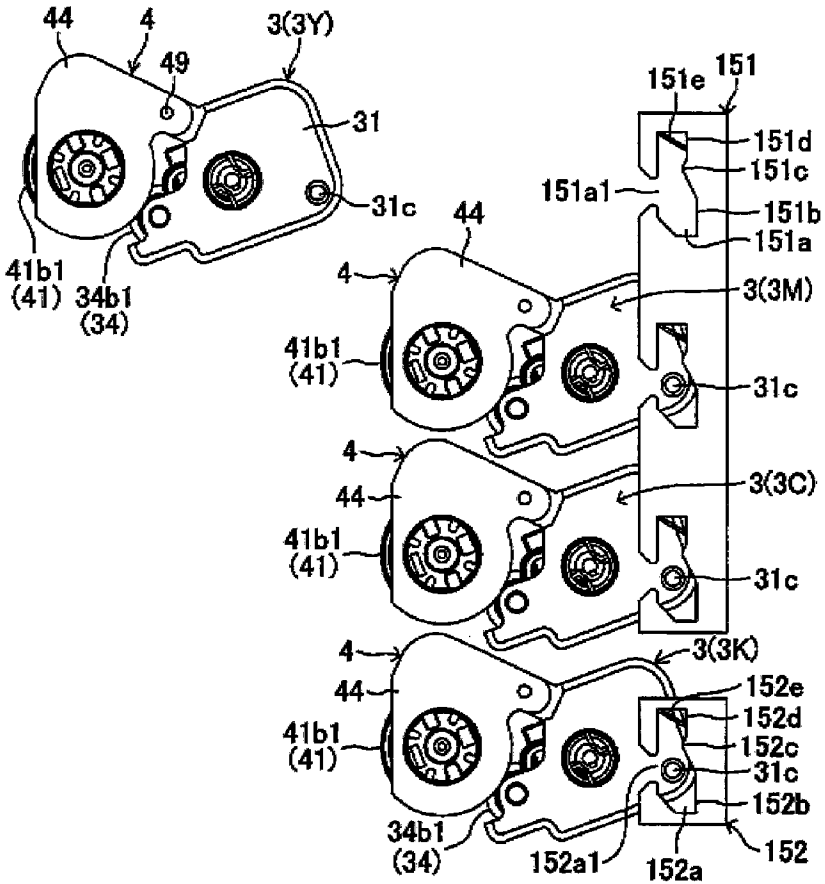
FIG. 12A is a side view around the drum units and the developing units when one of the drum units is removed from a primary slide cam according to the second embodiment.

The rear cover 11*f* is opened upon attaching and detaching the developing unit 3 as shown in FIG. 10. At this time, the primary and secondary slide cams 151 and 152 slidingly moves to an exchanging position, as shown in FIGS. 10 and 12A, between a separating position where the slide cams 151 and 152 are disposed at an uppermost position and a high pressure position where the positioning protrusion 31*c* is in abutment with the high pressure portions 151*c* and 152*c*, in conjunction with the opening of the rear cover 11*f*. Consequently, each positioning protrusion 31*c* is positioned vertically aligned with each opening 151*a*1 and 151*a*2, thereby smoothly detaching each developing unit 3.

Figures 13A, 13B, 13C:
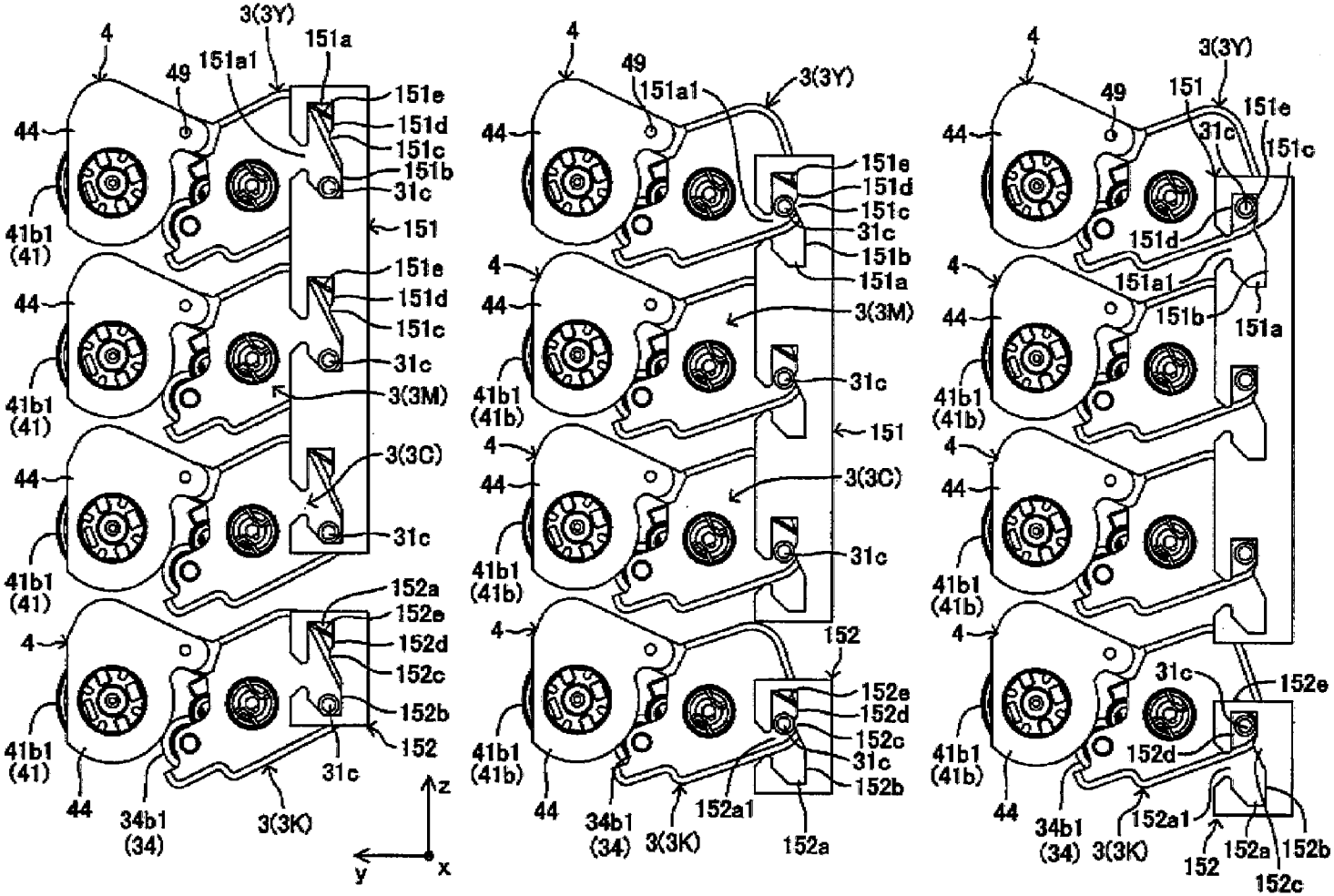
FIG. 13A is a side view around the drum units and the developing units when the primary slide cam and a secondary slide cam are disposed at an uppermost position according to the second embodiment.
FIG. 13B is a side view around the drum units and the developing units when the primary slide cam and the secondary slide cam are disposed at an intermediate position according to the second embodiment.
FIG. 13C is a side view around the drum units and the developing units when the primary slide cam and the secondary slide cam are disposed at a lowermost position according to the second embodiment.

While the printing operation is not performed, as shown in FIG. 13A, the slide cams 151 and 152 simultaneously move upward (positive side of z-axis). Each positioning protrusion 31*c* is respectively positioned at the separating portions 151*b* and 152*b*, relatively separating from the photosensitive drum 41. As a result, the toner carrying surface 34*b*1 and the image bearing surface 41*b*1 are separated from each other, i.e., in the separating state.

Upon stating the printing operation, the slide cams 151 and 152 simultaneously move downward (negative side of z-axis) from a state shown in FIG. 13A.

Each of the positioning protrusions 31*c* in the yellow developing unit 3Y, the magenta developing unit 3M, and the cyan developing unit 3C moves from the separating portion 151*b* to the normal pressure portion 151*d* in the guide slot 151*a*. When the positioning protrusion 31*c* is positioned at the high pressure portion 151*c* halfway between the separating portion 151*b* and the normal pressure portion 151*d* as shown in FIG. 13B, the positioning protrusion 31*c* is urged rearward (positive side of y-axis) by the high pressure portion 151*c*. As a result, the toner carrying surface 34*b*1 is brought into intimate contact with the image bearing surface 41*b*1 so as to provide higher pressure therebetween than in the normal contacting state. Subsequently, as shown in FIG. 13C, the positioning protrusion 31*c* reaches the normal pressure portion 151*d*. Then, the spring 151*e* urges the positioning protrusion 31*c* rearward so as to provide the normal contacting state between the toner carrying surface 34*b*1 and the image bearing surface 41*b*1.

In the black developing unit 3K, upon moving the secondary slide cam 152 downward from the state shown in FIG. 13A, the positioning protrusion 31*c* moves from the separating portion 152*b* to the normal pressure portion 152*d* in the guide slot 152*a*. When the positioning protrusion 31*c* is positioned at the high pressure portion 152*c* halfway between the separating portion 152*b* and the normal pressure portion 152*d* as shown in FIG. 13B, the positioning protrusion 31*c* is urged rearward (positive side of y-axis) by the high pressure portion 152*c*. As a result, the toner carrying surface 34*b*1 is brought into intimate contact with the image bearing surface 41*b*1 so as to provide higher pressure therebetween than in the normal contacting state. Subsequently, as shown in FIG. 13C, the positioning protrusion 31*c* reaches the normal pressure portion 152*d*. Then, the spring 152*e* urges the positioning protrusion 31*c* rearward to provide the normal contacting state between the toner carrying surface 34*b*1 and the image bearing surface 41*b*1.

Figure 14:
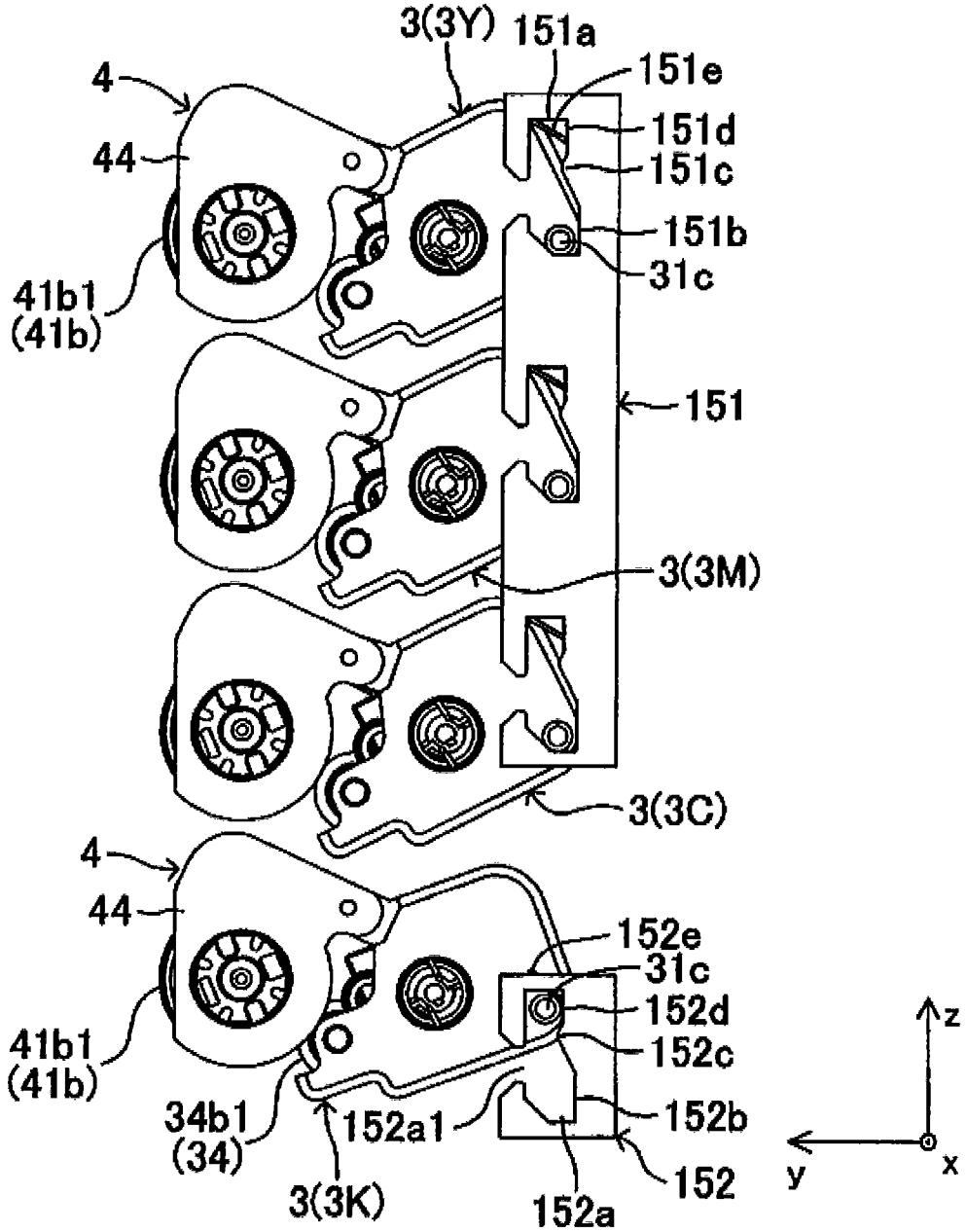
FIG. 14 is a side view around the drum units and the developing units when the primary slide cam is disposed at the uppermost position and the secondary slide cam is disposed at the lowermost position according to the second embodiment.

Since the main frame 10 includes the primary slide cam 151 and the secondary slide cam 152, the secondary slide cam 152 is movable independently from the primary slide cam 151 as shown in FIG. 14. Thus, only the black developing unit 3K which runs out more frequently than the other three developing units 3 can be exchangeable while the other three developing units 3 are at the normal contacting state.

Modification of the Second Embodiment

Figure 15:
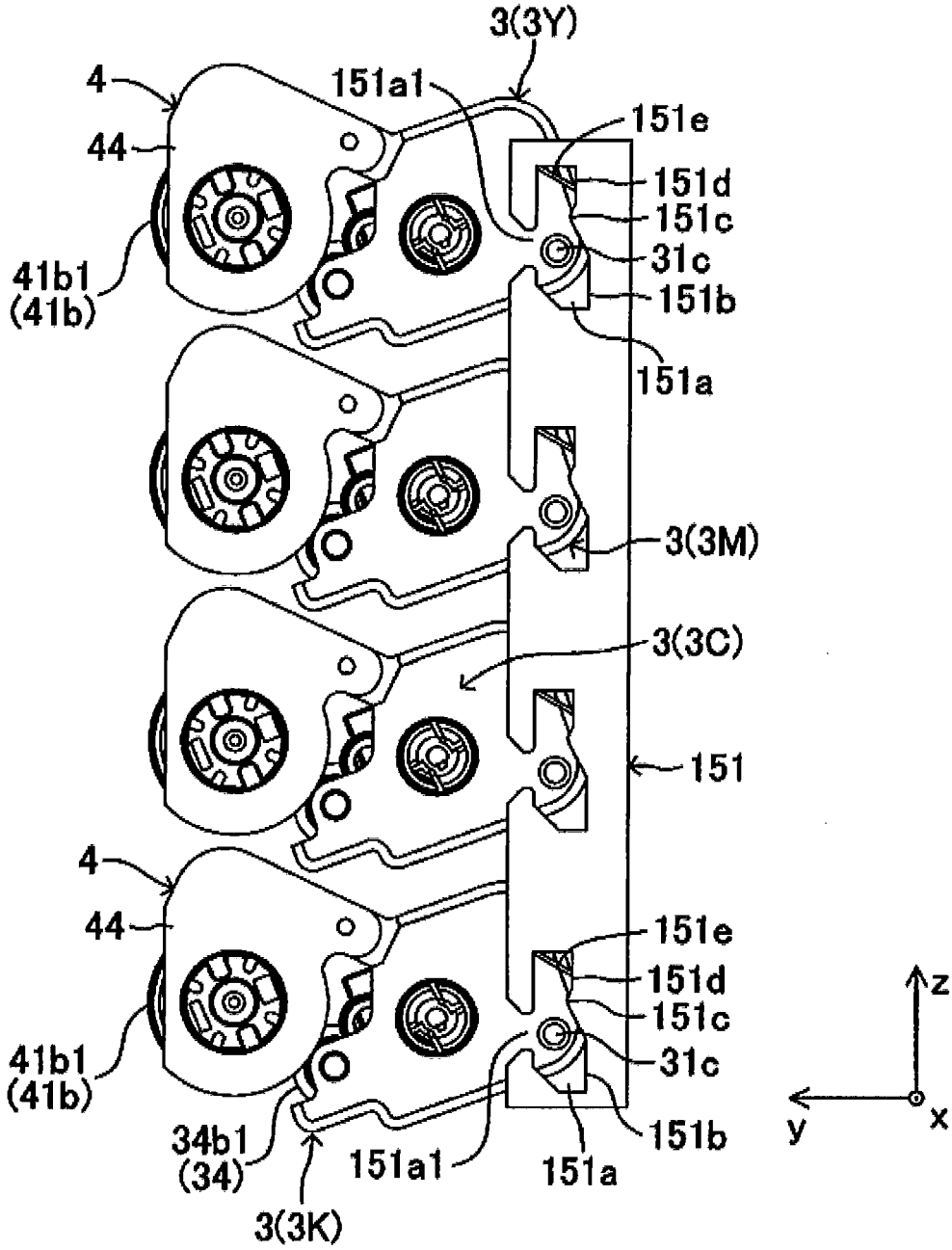
FIG. 15 is a side view of developing units, drum units, and a primary slide cam according to a first modification of the second embodiment.

A modification of the second embodiment will be described with reference to FIG. 15 wherein like parts and components are designated by the same reference numerals to avoid duplicating description. A single slide cam 151 may adjust the contacting state between the toner carrying surface 34*b*1 and the image bearing surface 41*b*1 in the yellow developing unit 3Y, the magenta developing unit 3M, the cyan developing unit 3C, and the black developing unit 3K in conjunction with one another.

Contrarily, four slide cams 151 (152) individually corresponding to four developing units 3 may be provided for adjusting the contacting state between the toner carrying surface 34*b*1 and the image bearing surface 41*b*1 in the yellow developing unit 3Y, the magenta developing unit 3M, the cyan developing unit 3C, and the black developing unit 3K.

What is claimed is:

1. An image forming device comprising:

a photosensitive unit configured to support a photosensitive body;

a developing unit including a developer carrying body and a unit case supporting the developer carrying body so as to expose a part of the developer carrying body, the developing unit being mounted to the photosensitive unit such that the developer carrying body is in confrontation with the photosensitive body; and a positioning unit configured to slide in a sliding direction to adjust a contact state between the developer carrying body and the photosensitive body, the positioning unit including a guide unit extending in the sliding direction, the guide unit comprising a separating portion configured to separate the developer carrying body from the photosensitive body, a normal pressure portion configured to provide a normal pressure contact between the developer carrying body and the photosensitive body, and a high pressure portion configured to provide a high pressure contact between the developer carrying body and the photosensitive body, a pressure in the high pressure contact being higher than a pressure in the normal pressure contact, the normal pressure contact being such a pressure that the developer carrying body and the photosensitive body are held during a printing operation, the separating portion extending in the sliding direction along a first plane, the normal pressure portion extending in the sliding direction along a second plane, wherein the second plane is positioned closer to an axis of the photosensitive body than is the first plane, the high pressure portion being positioned between the normal pressure portion and the separating portion in the sliding direction and protruding toward a photosensitive body side.

2. The image forming device according to claim 1, wherein the guide unit is configured to operate the separating portion, the high pressure portion, and the normal pressure portion in this order upon the attachment of the developing unit to the photosensitive unit.

3. The image forming device according to claim 1, wherein the separating portion, the high pressure portion, and the normal pressure portion are integrally formed.

4. The image forming device according to claim 3, wherein the photosensitive unit includes a plurality of photosensitive bodies, each of the plurality of photosensitive bodies having a cylindrical shape, the plurality of photosensitive bodies being arranged in the sliding direction orthogonal to an axial direction of the photosensitive body, wherein the separating portion and the high pressure portion are arranged along the sliding direction.

5. The image forming device according to claim 1, wherein the developing unit is detachably mounted in the photosensitive unit.

6. The image forming device according to claim 1, wherein the developing unit is swingably connected to the photosensitive unit, wherein the developing unit and the photosensitive unit are replaceable with a new developing unit and a new photosensitive unit.

7. The image forming device according to claim 1, wherein the developer carrying body includes a shaft guided by the guide unit.

8. The image forming device according to claim 1, wherein the developing unit includes a boss in contact with the guide unit.

9. The image forming device according to claim 1, wherein the guide unit is formed with an opening for an attachment and a detachment of the developing unit, the opening being positioned in confrontation with the separating portion.

10. The image forming device according to claim 1, wherein the guide unit further includes a slanted surface connecting the high pressure portion with the separating portion.

11. A drum unit to which a developing unit including a cylindrical developer carrying body is detachably mounted, the drum unit comprising:

a frame configured to support a photosensitive body; and a positioning unit configured to slide in a sliding direction to adjust a contact state between the developer carrying body and the photosensitive body, the positioning unit including a guide portion extending in the sliding direction, the guide portion comprising a separating portion configured to separate the developer carrying body from the photosensitive body, a normal pressure portion configured to provide a normal pressure contact between the developer carrying body and the photosensitive body, and a high pressure portion configured to provide a high pressure contact between the developer carrying body and the photosensitive body, a pressure in the high pressure contact being higher than a pressure in the normal pressure contact, the normal pressure contact being such a pressure that the developer carrying body and the photosensitive body are held during a printing operation, the separating portion extending in the sliding direction along a first plane, the normal pressure portion extending in the sliding direction along a second plane, wherein the second plane is positioned closer to an axis of the photosensitive body than is the first plane, the high pressure portion being positioned between the normal pressure portion and the separating portion in the sliding direction and protruding toward a photosensitive body side.

12. The image forming device according to claim 11, wherein the guide portion further includes a slanted surface connecting the high pressure portion with the separating portion.

* * * * *